US012781324B2

(12) United States Patent
Yoshida et al.

(10) Patent No.: US 12,781,324 B2
(45) Date of Patent: Nov. 3, 2026

(54) STEEL MATERIAL SUITABLE FOR USE IN SOUR ENVIRONMENT

(71) Applicant: NIPPON STEEL CORPORATION, Tokyo (JP)

(72) Inventors: Shinji Yoshida, Tokyo (JP); Yuji Arai, Tokyo (JP); Hiroyuki Fuji, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 590 days.

(21) Appl. No.: 18/044,249

(22) PCT Filed: Oct. 29, 2021

(86) PCT No.: PCT/JP2021/040108

§ 371 (c)(1),
(2) Date: Mar. 7, 2023

(87) PCT Pub. No.: WO2022/102441

PCT Pub. Date: May 19, 2022

(65) Prior Publication Data

US 2023/0366070 A1 Nov. 16, 2023

(30) Foreign Application Priority Data

Nov. 11, 2020 (JP) ..... 2020-187916

(51) Int. Cl.

| | |
|---|---|
| ***C21D 9/08*** | (2006.01) |
| ***C21D 1/26*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/28*** | (2006.01) |
| ***C22C 38/32*** | (2006.01) |
| ***C22C 38/34*** | (2006.01) |
| *C21D 1/25* | (2006.01) |
| *C21D 8/10* | (2006.01) |
| *C21D 9/46* | (2006.01) |
| *C22C 38/20* | (2006.01) |
| *C22C 38/26* | (2006.01) |
| *C22C 38/30* | (2006.01) |
| *C22C 38/44* | (2006.01) |
| *C22C 38/46* | (2006.01) |
| *C22C 38/50* | (2006.01) |
| *C22C 38/54* | (2006.01) |

(52) U.S. Cl.

CPC ..... *C22C 38/34* (2013.01); *C21D 1/26* (2013.01); *C21D 6/002* (2013.01); *C21D 9/08* (2013.01); *C22C 38/001* (2013.01); *C22C 38/002* (2013.01); *C22C 38/04* (2013.01); *C22C 38/06* (2013.01); *C22C 38/22* (2013.01); *C22C 38/24* (2013.01); *C22C 38/28* (2013.01); *C22C 38/32* (2013.01); *C21D 1/25* (2013.01); *C21D 6/008* (2013.01); *C21D 8/10* (2013.01); *C21D 9/085* (2013.01); *C21D 9/46* (2013.01); *C21D 2211/002* (2013.01); *C21D 2211/008* (2013.01); *C22C 38/02* (2013.01); *C22C 38/20* (2013.01); *C22C 38/26* (2013.01); *C22C 38/30* (2013.01); *C22C 38/44* (2013.01); *C22C 38/46* (2013.01); *C22C 38/50* (2013.01); *C22C 38/54* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 2009/0047166 | A1 | 2/2009 | Tomomatsu et al. | |
| 2014/0234660 | A1* | 8/2014 | Kawata | C23C 2/0224 148/504 |
| 2021/0269902 | A1 | 9/2021 | Yoshida et al. | |
| 2021/0371961 | A1* | 12/2021 | Yoshida | C22C 38/001 |

FOREIGN PATENT DOCUMENTS

| | | | | |
|---|---|---|---|---|
| JP | 09249935 | A | 9/1997 | |
| JP | 2000297344 | A | 10/2000 | |
| JP | 2001271134 | A | 10/2001 | |
| WO | 2008123422 | A1 | 10/2008 | |
| WO | WO-2010109702 | A1 * | 9/2010 | C21D 8/0473 |
| WO | 2020071217 | A1 | 4/2020 | |

OTHER PUBLICATIONS

English machine translation of WO 2010/109702 A1 of Hata (Year: 2010).*

* cited by examiner

*Primary Examiner* — Jophy S. Koshy

(74) *Attorney, Agent, or Firm* — Greer, Burns & Crain, Ltd.

(57) ABSTRACT

The steel material according to the present disclosure contains, in mass %, C: 0.20 to 0.45%, Si: 1.36 to 3.20%, Mn: 0.02 to 1.00%, P: 0.025% or less, S: 0.0100% or less, Al: 0.005 to 0.100%, Cr: 0.20 to 1.50%, Mo: 0.36 to 1.50%, V: 0.01 to 0.90%, Ti: 0.002 to 0.050%, B: 0.0001 to 0.0050%, N: 0.0100% or less, and O: 0.0100% or less, and satisfies Formula (1). A yield strength $\sigma_{YS}$ is 758 MPa or more. The yield strength $\sigma_{YS}$ and a dislocation density ρ satisfy Formula (2).

$$27\times Mn+9\times Cr-14\times Mo-770\times C^2+760\times C-11\times Si^2+4\times Si>85 \quad (1)$$

$$691<\sigma_{YS}-110\times\sqrt{\rho}\times10^{-7}\leq795 \quad (2)$$

3 Claims, 3 Drawing Sheets

STEEL MATERIAL SUITABLE FOR USE IN SOUR ENVIRONMENT

TECHNICAL FIELD

The present disclosure relates to a steel material, and more particularly relates to a steel material suitable for use in a sour environment.

BACKGROUND ART

Due to the deepening of oil wells and gas wells (hereunder, oil wells and gas wells are collectively referred to as "oil wells"), there is a demand to enhance strength of oil-well steel materials represented by oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for oil-well steel pipes of 110 ksi or more (yield strength is 758 MPa or more).

Furthermore, most deep wells are in a sour environment containing corrosive hydrogen sulfide. In the present description, the term "sour environment" means an acidified environment containing hydrogen sulfide. Note that, in some cases a sour environment may also contain carbon dioxide. Oil-well steel pipes for use in such sour environments are required to have not only high strength, but to also have sulfide stress cracking resistance (hereunder, referred to as "SSC resistance"). Thus, a steel material which has high strength and excellent SSC resistance has started to be demanded.

In addition, in recent years, deep wells beneath the surface of the sea are being actively developed. For example, in so-called "deep-sea offshore oil fields" that are at a water depth of 2000 meters or more, the water temperature is low. In such a case, SSC resistance in a low-temperature sour environment is also required. However, normally, the sulfide stress cracking susceptibility of a steel material increases as the environmental temperature decreases. Therefore, a steel material for oil wells, as typified by an oil-well steel pipe, which has high strength and also has excellent SSC resistance in a low-temperature sour environment has started to be demanded.

Technology for increasing the SSC resistance of steel materials as typified by oil-well steel pipes is proposed in Japanese Patent Application Publication No. 2000-297344 (Patent Literature 1), Japanese Patent Application Publication No. 2001-271134 (Patent Literature 2), and International Application Publication No.WO2008/123422 (Patent Literature 3).

A steel for oil wells that is disclosed in Patent Literature 1 contains, in mass %, C: 0.15 to 0.3%, Cr: 0.2 to 1.5%, Mo: 0.1 to 1%, V: 0.05 to 0.3%, and Nb: 0.003 to 0.1%. In this steel for oil wells, the amount of precipitating carbides is within the range of 1.5 to 4% by mass, the proportion that MC-type carbides occupy among the amount of carbides is within the range of 5 to 45% by mass, and when the wall thickness of the product is taken as t (mm), the proportion of $M_{23}C_6$-type carbides is (200/t) or less in percent by mass. It is described in Patent Literature 1 that the aforementioned steel for oil wells is excellent in SSC resistance.

A low-alloy steel material that is disclosed in Patent Literature 2 consists of, in mass %, C: 0.2 to 0.35%, Si: 0.05 to 0.5%, Mn: 0.1 to 1%, P: 0.025% or less, S: 0.01% or less, Cr: 0.1 to 1.2%, Mo: 0.1 to 1%, B: 0.0001 to 0.005%, Al: 0.005 to 0.1%, N: 0.01% or less, V: 0.05 to 0.5%, Ni: 0.1% or less, W: 1.0% or less and O: 0.01% or less, with the balance being Fe and impurities, and satisfies the formula ($0.03 \leq Mo \times V \leq 0.3$) and the formula ($0.5 \times Mo - V + GS/10 \geq 1$) and has a yield strength of 1060 MPa or more. Note that, "GS" in the formula represents the ASTM grain size number of prior-austenite grains. It is described in Patent Literature 2 that the aforementioned low-alloy steel material is excellent in SSC resistance.

A low-alloy steel disclosed in Patent Literature 3 consists of, in mass %, C: 0.10 to 0.20%, Si: 0.05 to 1.0%, Mn: 0.05 to 1.5%, Cr: 1.0 to 2.0%, Mo: 0.05 to 2.0%, Al: 0.10% or less and Ti: 0.002 to 0.05%, with Ceq ($=C+(Mn/6)+(Cr+Mo+V)/5$) being 0.65 or more, and with the balance being Fe and impurities, and among the impurities the low-alloy steel contains P: 0.025% or less, S: 0.010% or less, N: 0.007% or less, and B: less than 0.0003%. In the low-alloy steel, the amount of $M_{23}C_6$-type precipitates having a grain size of 1 μm or more is not more than 0.1 per $mm^2$. It is described in Patent Literature 3 that in the low-alloy steel, SSC resistance is enhanced.

CITATION LIST

Patent Literature

Patent Literature 1: Japanese Patent Application Publication No. 2000-297344

Patent Literature 2: Japanese Patent Application Publication No. 2001-271134

Patent Literature 3: International Application Publication No. WO 2008/123422

SUMMARY OF INVENTION

Technical Problem

As described above, in recent years, accompanying the increasing severity of oil well environments, there is a demand for steel materials having more excellent SSC resistance than heretofore. Therefore, a steel material (for example, a steel material for oil wells) having excellent SSC resistance may be obtained by techniques other than the techniques disclosed in the aforementioned Patent Literatures 1 to 3.

An objective of the present disclosure is to provide a steel material that has excellent SSC resistance in a room-temperature sour environment and a low-temperature sour environment.

Solution to Problem

A steel material according to the present disclosure consists of, in mass %,

C: 0.20 to 0.45%,
Si: 1.36 to 3.20%,
Mn: 0.02 to 1.00%,
P: 0.025% or less,
S: 0.0100% or less,
Al: 0.005 to 0.100%,
Cr: 0.20 to 1.50%,
Mo: 0.36 to 1.50%,
V: 0.01 to 0.90%,
Ti: 0.002 to 0.050%,
B: 0.0001 to 0.0050%,
N: 0.0100% or less,
O: 0.0100% or less, Nb: 0 to 0.030%,
Ca: 0 to 0.0100%,
Mg: 0 to 0.0100%,
Zr: 0 to 0.0100%,
rare earth metal: 0 to 0.0100%,
Co: 0 to 0.50%,
W: 0 to 0.50%,
Ni: 0 to 0.50%, and
Cu: 0 to 0.50%,
with the balance being Fe and impurities, and satisfies Formula (1), wherein a yield strength $\sigma_{YS}$ is 758 MPa or more, and the yield strength $\sigma_{YS}$ and a dislocation density ρ satisfy Formula (2):

$$27\times Mn+9\times Cr-14\times Mo-770\times C^2+760\times C-11\times Si^2+4\times Si>85 \quad (1)$$

$$691<\sigma_{YS}-110\times\sqrt{\rho}\times 10^{-7}\leq 795 \quad (2)$$

where, a content in mass % of a corresponding element is substituted for each symbol of an element in Formula (1); and in Formula (2) a yield strength in MPa is substituted for $\sigma_{YS}$, and a dislocation density in $m^{-2}$ is substituted for ρ.

Advantageous Effects of Invention

The steel material according to the present disclosure has excellent SSC resistance in a room-temperature sour environment and a low-temperature sour environment.

DESCRIPTION OF EMBODIMENTS

The present inventors conducted investigations and studies regarding a method for obtaining excellent SSC resistance in both a room-temperature sour environment and a low-temperature sour environment with respect to a steel material that will assumedly be used in a sour environment. As a result, the present inventors obtained the following findings.

First, the present inventors focused on the chemical composition, and conducted investigations and studies with regard to steel materials having excellent SSC resistance in a room-temperature sour environment and a low-temperature sour environment. As a result, the present inventors considered that if a steel material has a chemical composition containing, in mass %, C: 0.20 to 0.45%, Mn: 0.02 to 1.00%, P: 0.025% or less, S: 0.0100% or less, Al: 0.005 to 0.100%, Cr: 0.20 to 1.50%, Mo: 0.36 to 1.50%, V: 0.01 to 0.90%, Ti: 0.002 to 0.050%, B: 0.0001 to 0.0050%, N: 0.0100% or less, O: 0.0100% or less, Nb: 0 to 0.030%, Ca: 0 to 0.0100%, Mg: 0 to 0.0100%, Zr: 0 to 0.0100%, rare earth metal: 0 to 0.0100%, Co: 0 to 0.50%, W: 0 to 0.50%, Ni: 0 to 0.50%, and Cu: 0 to 0.50%, there is a possibility of obtaining excellent SSC resistance in a room-temperature sour environment and a low-temperature sour environment.

Here, if the dislocation density in the steel material is increased, the yield strength of the steel material will increase. However, there is a possibility that dislocations will occlude hydrogen. Therefore, if the dislocation density of the steel material increases, there is a possibility that the amount of hydrogen that the steel material occludes will also increase. That is, if the hydrogen concentration in the steel material increases as a result of increasing the dislocation density, even if high strength is obtained, the SSC resistance of the steel material will decrease. Accordingly, in a case where the yield strength is increased to, for example, 110 ksi or more (758 MPa or more) by increasing the dislocation density, there is a possibility that excellent SSC resistance will not be sufficiently obtained in a room-temperature sour environment and a low-temperature sour environment.

Therefore, the present inventors studied methods for reducing the dislocation density with respect to a steel material having a yield strength of 110 ksi or more (758 MPa or more) as one example among steel materials having the aforementioned chemical composition. As a result, the present inventors discovered that by increasing the Si content, even in a case where the yield strength of the steel material is increased to 110 ksi or more (758 MPa or more), there is a possibility that the dislocation density can be reduced. This point will now be described specifically using the accompanying drawings.

Figure 1A:
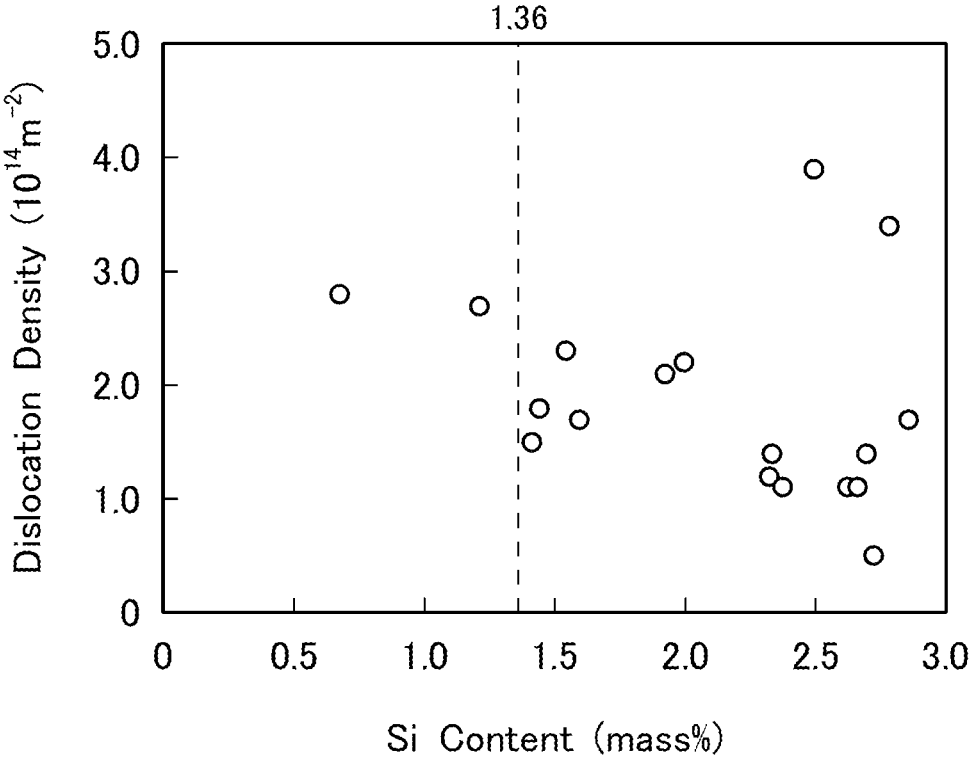
FIG. 1A is a view illustrating the relation between the Si content and the dislocation density in examples having a yield strength of 110 ksi grade (758 to less than 862 MPa) among the present examples.
Figure 1B:
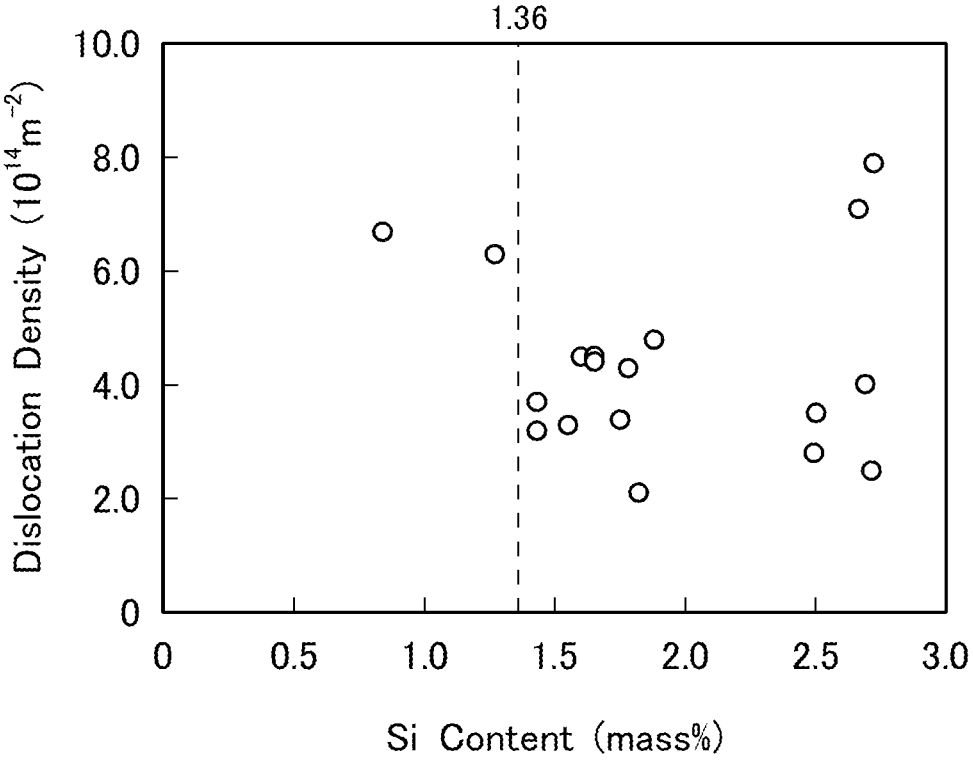
FIG. 1B is a view illustrating the relation between the Si content and the dislocation density in examples having a yield strength of 125 ksi grade (862 to less than 965 MPa) among the present examples.
Figure 1C:
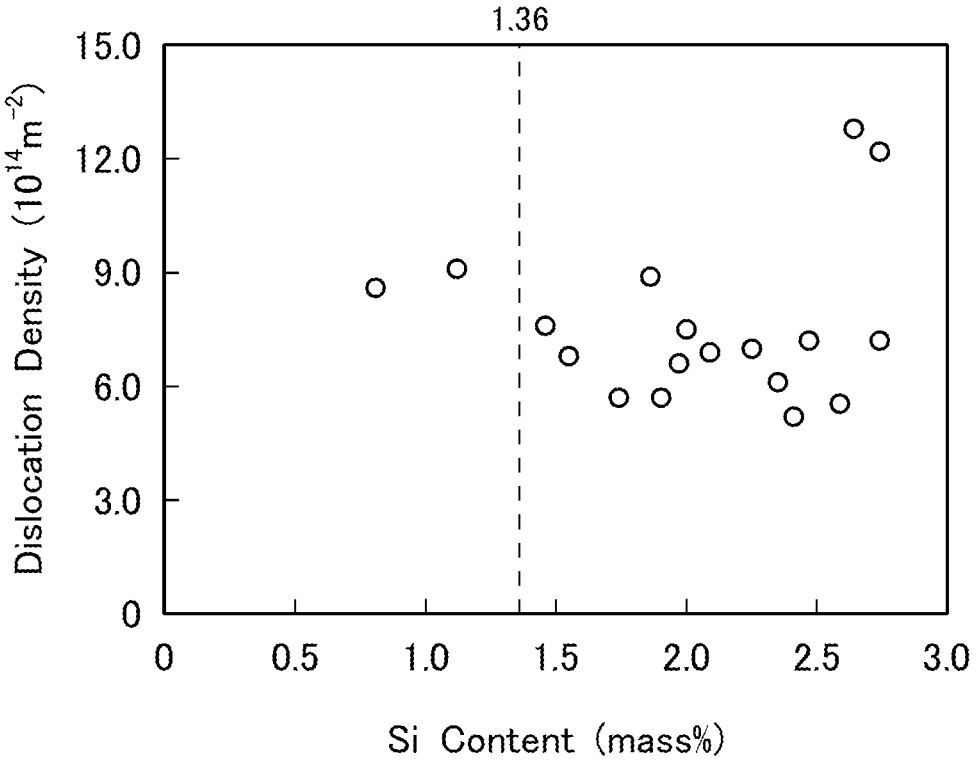
FIG. 1C is a view illustrating the relation between the Si content and the dislocation density in examples having a yield strength of 140 ksi or more (965 MPa or more) among the present examples.

FIG. 1A to FIG. 1C are views illustrating the relation between Si content and dislocation density in the present examples. FIG. 1A was created using the Si content (mass %) and the dislocation density ρ (1014 $m^{-2}$) with respect to examples which, among examples that are described later, had the aforementioned chemical composition and a yield strength of 110 ksi grade (758 to less than 862 MPa) and which were produced by a preferable production method that is described later. FIG. 1B was created using the Si content (mass %) and the dislocation density ρ ($10^{14}$ $m^{-2}$) with respect to examples which, among the examples that are described later, had the aforementioned chemical composition and a yield strength of 125 ksi grade (862 to less than 965 MPa) and which were produced by a preferable production method that is described later. FIG. 1C was created using the Si content (mass %) and the dislocation density ρ ($10^{14}$ $m^{-2}$) with respect to examples which, among the examples that are described later, had the aforementioned chemical composition and a yield strength of 140 ksi or more (965 MPa or more) and which were produced by a preferable production method that is described later. Note that, the dislocation density ρ was determined using a method that is described later.

Referring to FIG. 1A to FIG. 1C, it was found that in steel materials which had the aforementioned chemical composition and which were produced by a preferable production method to be described later, if the Si content is increased, there is a tendency for the dislocation density ρ to decrease, even when the yield strength is the same level. In particular, when the Si content is 1.36% or more, there is a marked decrease in the dislocation density ρ, and there is a possibility that the SSC resistance of the steel material will be increased not only in a room-temperature sour environment, but also in a low-temperature sour environment. That is, as the result of detailed studies conducted by the present inventors it was clarified that if a steel material has a chemical composition consisting of, in mass %, C: 0.20 to 0.45%, Si: 1.36 to 3.20%, Mn: 0.02 to 1.00%, P: 0.025% or less, S: 0.0100% or less, Al: 0.005 to 0.100%, Cr: 0.20 to 1.50%, Mo: 0.36 to 1.50%, V: 0.01 to 0.90%, Ti: 0.002 to 0.050%, B: 0.0001 to 0.0050%, N: 0.0100% or less, O: 0.0100% or less, Nb: 0 to 0.030%, Ca: 0 to 0.0100%, Mg: 0 to 0.0100%, Zr: 0 to 0.0100%, rare earth metal: 0 to 0.0100%, Co: 0 to 0.50%, W: 0 to 0.50%, Ni: 0 to 0.50%, and Cu: 0 to 0.50%, with the balance being Fe and impurities, there is a possibility that the dislocation density will be further reduced and excellent SSC resistance will be obtained in a room-temperature sour environment and a low-temperature sour environment.

On the other hand, referring further to FIG. 1A to FIG. 1C, it was confirmed that even when a steel material has the aforementioned chemical composition and has a yield strength of the same level, the dislocation density cannot be consistently reduced in some cases. Specifically, referring to the right upper parts of FIG. 1A to FIG. 1C, even for steel materials with an Si content of 1.36% or more, cases were confirmed in which the dislocation density was higher than in a steel material with an Si content of less than 1.36%. That is, it was revealed by the detailed studies conducted by the present inventors that, if the aforementioned chemical composition is merely adjusted, even when the steel material is produced by a preferable production method described later, there are cases where the dislocation density cannot be adequately reduced.

Further, the present inventors found that in the case of a steel material having the aforementioned chemical composition, as a result of increasing the Si content to 1.36% or more, a change occurs in the relation between the dislocation density ρ and the yield strength in comparison to a steel material in which the Si content is low. That is, in a steel material having the aforementioned chemical composition, even if the dislocation density ρ is reduced to the same level as in a steel material in which the Si content is low, there is a possibility that excellent SSC resistance cannot be obtained, particularly in a low-temperature sour environment. Therefore, the present inventors conducted detailed studies directed at clarifying, with respect to a steel material having the aforementioned chemical composition, what level to reduce the dislocation density ρ to in order to obtain excellent SSC resistance even in a low-temperature sour environment.

As a result, it was revealed that, in the case of a steel material having the aforementioned chemical composition, when the dislocation density ρ and the yield strength $\sigma_{YS}$ satisfy the following Formula (2), excellent SSC resistance is obtained not just in a room-temperature sour environment, but also in a low-temperature sour environment.

$$691<\sigma_{YS}-110\times\sqrt{\rho}\times10^{-7}\leq795 \quad (2)$$

Where, in Formula (2), a yield strength in MPa is substituted for $\sigma_{YS}$, and a dislocation density in $m^{-2}$ is substituted for ρ.

It is defined that $Fn2=\sigma_{YS}-110\times\sqrt{\rho}\times10^{-7}$. Fn2 is an index that indicates SSC resistance in a low-temperature sour environment. Specifically, in the case of a steel material having the aforementioned chemical composition, if Fn2 is more than 691, on the condition that the other requirements according to the present embodiment are satisfied, excellent SSC resistance can be obtained in a low-temperature sour environment also, and not just a room-temperature sour environment.

On the other hand, as mentioned above, in the case of a steel material having the aforementioned chemical composition in which the Si content is increased to 1.36% or more, the dislocation density ρ cannot be adequately reduced in some cases. In such a case, the dislocation density ρ and the yield strength $\sigma_{YS}$ cannot satisfy Formula (2). Regarding the reason for this, the present inventors considered that this may be because, in the aforementioned chemical composition, as a result of the Si content being increased to 1.36% or more, the relation between the dislocation density ρ and the yield strength $\sigma_{YS}$ is influenced by the balance between the contents of the respective elements in the chemical composition.

As a result of detailed studies conducted by the present inventors based on the findings described above, it was revealed that, in addition to having the aforementioned chemical composition, by the chemical composition also satisfying the following Formula (I), the dislocation density ρ can be consistently reduced.

$$27\times Mn+9\times Cr-14\times Mo-770\times C^2+760\times C-11\times Si^2+4\times Si>85 \quad (1)$$

Where, a content in mass % of a corresponding element is substituted for each symbol of an element in Formula (1).

It is defined that $Fn1=27\times Mn+9\times Cr-14\times Mo-770\times C^2+760\times C-11\times Si^2+4\times Si$. Fn1 is an index indicating the balance between the dislocation density ρ and the yield strength $\sigma_{YS}$ in the aforementioned chemical composition in which the Si content is 1.36% or more. That is, in a steel material according to the present embodiment, in addition to the aforementioned chemical composition having an Si content of 1.36% or more, Fn1 is also made higher than 85. As a result, Fn2 can be made higher than 691. This point will now be described specifically using the accompanying drawings.

Figure 2:
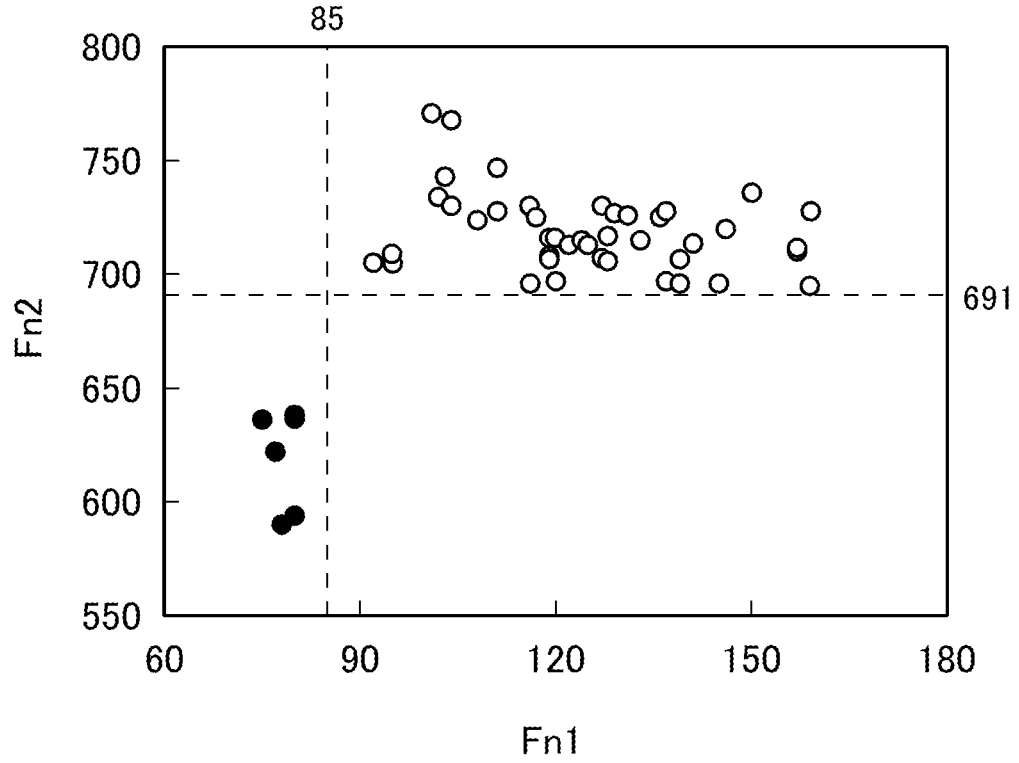
FIG. 2 is a view illustrating the relation between Fn1 ($=27\times Mn+9\times Cr-14\times Mo-770\times C^2+760\times C-11\times Si^2+4\times Si$), Fn2 ($=\sigma_{YS}-110\times\sqrt{\rho}10^{-7}$), and SSC resistance in the present examples.

FIG. 2 is a view illustrating the relation between Fn1 ($=27\times Mn+9\times Cr-14\times Mo-770\times C^2+760\times C-11\times Si^2+4\times Si$), Fn2 ($=\sigma_{YS}-110\times\sqrt{\rho}10^{-7}$), and SSC resistance in the present examples. FIG. 2 was created using Fn1, Fn2, and evaluation results of a low-temperature SSC resistance test in which evaluation was performed by a method described later with respect to, among the examples that are described later, examples having the aforementioned chemical composition and a yield strength of 110 ksi or more (758 MPa or more) that were produced by a preferable production method that is described later. The dislocation density ρ and the yield strength $\sigma_{YS}$ used for determining Fn2 were determined by a method that is described later. Here, the symbol "○" in FIG. 2 indicates a steel material that had excellent SSC resistance in the low-temperature SSC resistance test. On the other hand, the symbol "●" in FIG. 2 indicates a steel material that did not have excellent SSC resistance in the low-temperature SSC resistance test.

Referring to FIG. 2, in steel materials having the aforementioned chemical composition, at least within a range in which the yield strength is 110 ksi or more (758 MPa or more), Fn2 rapidly increases when Fn1 is more than 85. In addition, it is confirmed that, when Fn2 is more than 691, the steel materials have excellent SSC resistance in a low-temperature sour environment. On the other hand, in a steel material having the aforementioned chemical composition, when Fn1 is 85 or less, Fn2 becomes 691 or less, and excellent SSC resistance is not obtained in a low-temperature sour environment.

Therefore, in addition to having the aforementioned chemical composition, the steel material according to the present embodiment has a chemical composition that satisfies Formula (1), and furthermore, the dislocation density ρ and the yield strength $\sigma_{YS}$ of the steel material satisfy Formula (2). As a result, the steel material according to the present embodiment has excellent SSC resistance in not only a room-temperature sour environment but also a low-temperature sour environment, even when the yield strength $\sigma_{YS}$ is 758 MPa or more.

The gist of the steel material according to the present embodiment that has been completed based on the above findings is as follows.

[1]

A steel material consisting of, in mass %,

C: 0.20 to 0.45%,

Si: 1.36 to 3.20%,

Mn: 0.02 to 1.00%,

P: 0.025% or less,

S: 0.0100% or less,

Al: 0.005 to 0.100%,

Cr: 0.20 to 1.50%,

Mo: 0.36 to 1.50%,

V: 0.01 to 0.90%,

Ti: 0.002 to 0.050%,

B: 0.0001 to 0.0050%,

N: 0.0100% or less,

O: 0.0100% or less,

Nb: 0 to 0.030%,

Ca: 0 to 0.0100%,

Mg: 0 to 0.0100%,

Zr: 0 to 0.0100%, rare earth metal: 0 to 0.0100%,

Co: 0 to 0.50%,

W: 0 to 0.50%,

Ni: 0 to 0.50%, and

Cu: 0 to 0.50%, with the balance being Fe and impurities, and satisfying Formula (1), wherein a yield strength $\sigma_{YS}$ is 758 MPa or more, and the yield strength $\sigma_{YS}$ and a dislocation density ρ satisfy Formula (2):

$$27\times Mn+9\times Cr-14\times Mo-770\times C^2+760\times C-11\times Si^2+4\times Si>85 \quad (1)$$

$$691<\sigma_{YS}-110\times\sqrt{\rho}\times 10^{-7}\leq 795 \quad (2)$$

where, a content in mass % of a corresponding element is substituted for each symbol of an element in Formula (1); and in Formula (2) a yield strength in MPa is substituted for $\sigma_{YS}$, and a dislocation density in $m^{-2}$ is substituted for ρ.

[2]

The steel material according to [1], containing one or more elements selected from the group consisting of:

Nb: 0.002 to 0.030%,

Ca: 0.0001 to 0.0100%,

Mg: 0.0001 to 0.0100%,

Zr: 0.0001 to 0.0100%, rare earth metal: 0.0001 to 0.0100%,

Co: 0.02 to 0.50%,

W: 0.02 to 0.50%,

Ni: 0.01 to 0.50%, and

Cu: 0.01 to 0.50%.

[3]

The steel material according to [1] or [2], wherein:

the steel material is an oil-well steel pipe.

In the present description, the oil-well steel pipe may be a steel pipe used for oil country tubular goods. The oil-well steel pipe may be a seamless steel pipe or may be a welded steel pipe. The oil country tubular goods are, for example, steel pipes that are used for use in casing or tubing.

Preferably, an oil-well steel pipe according to the present embodiment is a seamless steel pipe. If the oil-well steel pipe according to the present embodiment is a seamless steel pipe, even if the wall thickness thereof is 15 mm or more, the oil-well steel pipe has excellent SSC resistance in a room-temperature sour environment and a low-temperature sour environment. In the present description, the term "room-temperature sour environment" means a sour environment with a temperature of 10 to 30° C. In the present description, the term "low-temperature sour environment" means a sour environment with a temperature of less than 10° C.

Hereunder, the steel material according to the present invention is described in detail. The symbol "%" in relation to an element means "mass percent" unless specifically stated otherwise.

[Chemical Composition]

The chemical composition of the steel material according to the present invention contains the following elements.

C: 0.20 to 0.45%

Carbon (C) enhances hardenability of the steel material and increases strength of the steel material. C also promotes spheroidization of carbides during tempering in the production process, and thereby enhances the SSC resistance of the steel material. If carbides are dispersed, strength of the steel material increases further. If the C content is too low, the aforementioned effects cannot be sufficiently obtained, even when the contents of other elements are within the range of the present embodiment. On the other hand, if the C content is too high, too many carbides will be produced and toughness of the steel material will decrease, even when the contents of other elements are within the range of the present embodiment. In addition, if the C content is too high, quench cracking is liable to occur during quenching in the production process in some cases. Therefore, the C content is within the range of 0.20 to 0.45%. A preferable lower limit of the C content is 0.22%, more preferably is 0.23%, further preferably is 0.24%, and more preferably is 0.25%. A preferable upper limit of the C content is 0.40%, more preferably is 0.38%, and further preferably is 0.37%.

Si: 1.36 to 3.20%

Silicon (Si) deoxidizes the steel. Si also reduces the dislocation density in the steel material and increases the SSC resistance of the steel material. If the Si content is too low, the aforementioned effects cannot be sufficiently obtained, even when the contents of other elements are within the range of the present embodiment. On the other hand, if the Si content is too high, the SSC resistance of the steel material decreases, even when the contents of other elements are within the range of the present embodiment. Therefore, the Si content is within the range of 1.36 to 3.20%. A preferable lower limit of the Si content is 1.38%, more preferably is 1.40%, further preferably is 1.45%, more preferably is 1.50%, and further preferably is 1.70%. A preferable upper limit of the Si content is 3.10%, more preferably is 3.00%, and further preferably is 2.90%.

Mn: 0.02 to 1.00%

Manganese (Mn) deoxidizes the steel. Mn also enhances hardenability of the steel material. If the Mn content is too low, the aforementioned effects cannot be obtained, even when the contents of other elements are within the range of the present embodiment. On the other hand, if the Mn content is too high, Mn segregates at grain boundaries together with impurities such as P and S. As a result, the SSC resistance of the steel material decreases, even when the contents of other elements are within the range of the present embodiment. Therefore, the Mn content is within a range of 0.02 to 1.00%. A preferable lower limit of the Mn content is 0.03%, more preferably is 0.05%, and further preferably is 0.10%. A preferable upper limit of the Mn content is 0.90%, more preferably is 0.80%, further preferably is 0.70%, and further preferably is 0.65%.

P: 0.025% or less

Phosphorous (P) is an impurity. That is, the lower limit of the P content is more than 0%. If the P content is too high, P segregates at the grain boundaries and decreases the SSC resistance of the steel material, even when the contents of other elements are within the range of the present embodiment. Therefore, the P content is 0.025% or less. A preferable upper limit of the P content is 0.020%, and more preferably is 0.015%. Preferably, the P content is as low as possible. However, if the P content is excessively reduced, the production cost increases significantly. Therefore, when taking industrial production into consideration, a preferable lower limit of the P content is 0.0001%, more preferably is 0.0003%, further preferably is 0.001%, and further preferably is 0.003%.

S: 0.0100% or less

Sulfur (S) is an impurity. That is, the lower limit of the S content is more than 0%. If the S content is too high, S segregates at the grain boundaries and decreases the SSC resistance of the steel material, even when the contents of other elements are within the range of the present embodiment. Therefore, the S content is 0.0100% or less. A preferable upper limit of the S content is 0.0050%, and more preferably is 0.0030%. Preferably, the S content is as low as possible. However, if the S content is excessively reduced, the production cost increases significantly. Therefore, when taking industrial production into consideration, a preferable lower limit of the S content is 0.0001%, more preferably is 0.0002%, and further preferably is 0.0003%.

Al: 0.005 to 0.100%

Aluminum (Al) deoxidizes the steel material. If the Al content is too low, the aforementioned effect cannot be sufficiently obtained, even when the contents of other elements are within the range of the present embodiment. On the other hand, if the Al content is too high, coarse oxide-based inclusions are formed and the SSC resistance of the steel material decreases, even when the contents of other elements are within the range of the present embodiment. Therefore, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means "acid-soluble Al", that is, the content of "sol. Al".

Cr: 0.20 to 1.50%

Chromium (Cr) enhances hardenability of the steel material. Cr also increases temper softening resistance of the steel material and enables high-temperature tempering. As a result, the SSC resistance of the steel material increase. If the Cr content is too low, the aforementioned effects cannot be sufficiently obtained, even when the contents of other elements are within the range of the present embodiment. On the other hand, if the Cr content is too high, the SSC resistance of the steel material will decrease, even when the contents of other elements are within the range of the present embodiment. Therefore, the Cr content is within a range of 0.20 to 1.50%. A preferable lower limit of the Cr content is 0.25%, more preferably is 0.30%, further preferably is 0.35%, and further preferably is 0.40%. A preferable upper limit of the Cr content is 1.40%, and more preferably is 1.30%.

Mo: 0.36 to 1.50%

Molybdenum (Mo) enhances hardenability of the steel material. Mo also increases temper softening resistance of the steel material and enables high-temperature tempering. As a result, the SSC resistance of the steel material increase. If the Mo content is too low, the aforementioned effects cannot be sufficiently obtained, even when the contents of other elements are within the range of the present embodiment. On the other hand, if the Mo content is too high, the aforementioned effects are saturated. Therefore, the Mo content is within a range of 0.36 to 1.50%. A preferable lower limit of the Mo content is 0.40%, more preferably is 0.50%, and further preferably is 0.60%. A preferable upper limit of the Mo content is 1.40%, more preferably is 1.30%, and further preferably is 1.25%.

V: 0.01 to 0.90%

Vanadium (V) combines with C and/or N to form carbides, nitrides or carbo-nitrides (hereinafter, referred to as "carbo-nitrides and the like"). Carbo-nitrides and the like refine the sub-microstructure of the steel material by the pinning effect, and increase the SSC resistance of the steel material. V also increases temper softening resistance and enables high-temperature tempering. As a result, the SSC resistance of the steel material increases. If the V content is too low, the aforementioned effects cannot be sufficiently obtained, even when the contents of other elements are within the range of the present embodiment. On the other hand, if the V content is too high, toughness of the steel material will decrease, even when the contents of other elements are within the range of the present embodiment. Therefore, the V content is within the range of 0.01 to 0.90%. A preferable lower limit of the V content is 0.02%, more preferably is 0.04%, further preferably is 0.06%, and further preferably is 0.08%. A preferable upper limit of the V content is 0.85%, more preferably is 0.80%, further preferably is 0.75%, more preferably is 0.70%, further preferably is 0.60%, and further preferably is 0.50%.

Ti: 0.002 to 0.050%

Titanium (Ti) combines with N to form nitrides, and thereby refines grains of the steel material by the pinning effect. As a result, strength of the steel material increases. If the Ti content is too low, the aforementioned effect cannot be sufficiently obtained, even when the contents of other elements are within the range of the present embodiment. On the other hand, if the Ti content is too high, Ti nitrides coarsen and the SSC resistance of the steel material decreases, even when the contents of other elements are within the range of the present embodiment. Therefore, the Ti content is within a range of 0.002 to 0.050%. A preferable lower limit of the Ti content is 0.003%, and more preferably is 0.005%. A preferable upper limit of the Ti content is 0.040%, more preferably is 0.030%, and further preferably is 0.020%.

B: 0.0001 to 0.0050%

Boron (B) dissolves in the steel, enhances hardenability of the steel material and increases the steel material strength. If the B content is too low, the aforementioned effect cannot be sufficiently obtained, even when the contents of other elements are within the range of the present embodiment. On the other hand, if the B content is too high, coarse nitrides form and the SSC resistance of the steel material decreases, even when the contents of other elements are within the range of the present embodiment. Therefore, the B content is within a range of 0.0001 to 0.0050%. A preferable lower limit of the B content is 0.0003%, and more preferably is 0.0007%. A preferable upper limit of the B content is 0.0030%, more preferably is 0.0025%, further preferably is 0.0020%, and further preferably is 0.0015%.

N: 0.0100% or less

Nitrogen (N) is unavoidably contained. That is, the lower limit of the N content is more than 0%. N combines with Ti to form nitrides, and thereby refines grains of the steel material by the pinning effect. As a result, strength of the steel material increases. However, if the N content is too high, coarse nitrides are formed and the SSC resistance of the steel material decreases, even when the contents of other elements are within the range of the present embodiment. Therefore, the N content is 0.0100% or less. A preferable upper limit of the N content is 0.0050%, and more preferably is 0.0045%. A preferable lower limit of the N content for more effectively obtaining the aforementioned effect is 0.0005%, more preferably is 0.0010%, further preferably is 0.0015%, and further preferably is 0.0020%.

O: 0.0100% or less

Oxygen (O) is an impurity. That is, the lower limit of the O content is more than 0%. If the O content is too high, O forms coarse oxides, and causes the low-temperature toughness and SSC resistance of the steel material to decrease, even when the contents of other elements are within the range of the present embodiment. Therefore, the O content is 0.0100% or less. A preferable upper limit of the O content is 0.0050%, more preferably is 0.0030%, and further preferably is 0.0020%. Preferably, the O content is as low as possible. However, if the O content is excessively reduced, the production cost increases significantly. Therefore, when taking industrial production into consideration, a preferable lower limit of the O content is 0.0001%, more preferably is 0.0002%, and further preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Optional Elements]

The chemical composition of the steel material described above may further contain Nb in lieu of a part of Fe.

Nb: 0 to 0.030%

Niobium (Nb) is an optional element, and need not be contained. That is, the Nb content may be 0%. If contained, Nb forms carbo-nitrides and the like. Carbo-nitrides and the like refine the grains of the steel material by the pinning effect, and increase low-temperature toughness and SSC resistance of the steel material. Nb also forms fine carbides during tempering and thereby increases temper softening resistance of the steel material and enhances strength of the steel material. If even a small amount of Nb is contained, the aforementioned effects can be obtained to a certain extent. However, if the Nb content is too high, carbo-nitrides and the like are excessively formed and the SSC resistance of the steel material decreases, even when the contents of other elements are within the range of the present embodiment. Therefore, the Nb content is within the range of 0 to 0.030%. A preferable lower limit of the Nb content is more than 0%, more preferably is 0.002%, further preferably is 0.003%, and further preferably is 0.007%. A preferable upper limit of the Nb content is 0.025%, and more preferably is 0.020%.

The chemical composition of the steel material described above may further contain one or more types of element selected from the group consisting of Ca, Mg, Zr and rare earth metal in lieu of a part of Fe. Each of these elements is an optional element, and render S in the steel material harmless by forming sulfides. As a result, these elements increase the SSC resistance of the steel material.

Ca: 0 to 0.0100%

Calcium (Ca) is an optional element, and need not be contained. That is, the Ca content may be 0%. If contained, Ca renders S in the steel material harmless by forming sulfides, and increases the SSC resistance of the steel material. If even a small amount of Ca is contained, the aforementioned effect can be obtained to a certain extent. However, if the Ca content is too high, oxides in the steel material coarsen and the SSC resistance of the steel material decreases, even when the contents of other elements are within the range of the present embodiment. Therefore, the Ca content is within the range of 0 to 0.0100%. A preferable lower limit of the Ca content is more than 0%, more preferably is 0.0001%, further preferably is 0.0003%, and further preferably is 0.0006%. A preferable upper limit of the Ca content is 0.0040%, more preferably is 0.0025%, and further preferably is 0.0020%.

Mg: 0 to 0.0100%

Magnesium (Mg) is an optional element, and need not be contained. That is, the Mg content may be 0%. If contained, Mg renders S in the steel material harmless by forming sulfides, and increases the SSC resistance of the steel material. If even a small amount of Mg is contained, the aforementioned effect can be obtained to a certain extent. However, if the Mg content is too high, oxides in the steel material coarsen and decrease the SSC resistance of the steel material, even when the contents of other elements are within the range of the present embodiment. Therefore, the Mg content is within the range of 0 to 0.0100%. A preferable lower limit of the Mg content is more than 0%, more preferably is 0.0001%, further preferably is 0.0003%, and further preferably is 0.0006%. A preferable upper limit of the Mg content is 0.0040%, more preferably is 0.0025%, and further preferably is 0.0020%.

Zr: 0 to 0.0100%

Zirconium (Zr) is an optional element, and need not be contained. That is, the Zr content may be 0%. If contained, Zr renders S in the steel material harmless by forming sulfides, and increases the SSC resistance of the steel material. If even a small amount of Zr is contained, the aforementioned effect can be obtained to a certain extent. However, if the Zr content is too high, oxides in the steel material coarsen and the SSC resistance of the steel material decreases, even when the contents of other elements are within the range of the present embodiment. Therefore, the Zr content is within the range of 0 to 0.0100%. A preferable lower limit of the Zr content is more than 0%, more preferably is 0.0001%, further preferably is 0.0003%, and further preferably is 0.0006%. A preferable upper limit of the Zr content is 0.0040%, more preferably is 0.0025%, and further preferably is 0.0020%.

Rare earth metal (REM): 0 to 0.0100%

Rare earth metal (REM) is an optional element, and need not be contained. That is, the REM content may be 0%. If contained, the REM renders S in the steel material harmless by forming sulfides, and increases the SSC resistance of the steel material. REM also combines with P in the steel material and suppresses segregation of P at the crystal grain boundaries. Therefore, a decrease in the SSC resistance of the steel material that is attributable to segregation of P is suppressed. If even a small amount of REM is contained, the aforementioned effects can be obtained to a certain extent. However, if the REM content is too high, oxides in the steel material coarsen and the SSC resistance of the steel material decreases, even when the contents of other elements are within the range of the present embodiment. Therefore, the REM content is within the range of 0 to 0.0100%. A preferable lower limit of the REM content is more than 0%, more preferably is 0.0001%, further preferably is 0.0003%, and further preferably is 0.0006%. A preferable upper limit of the REM content is 0.0040%, and more preferably is 0.0025%.

Note that, in the present description the term "REM" refers to one or more types of element selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

The chemical composition of the steel material described above may further contain one or more types of element selected from the group consisting of Co and W in lieu of a part of Fe. Each of these elements is an optional element that forms a protective corrosion coating in a sour environment and suppresses the penetration of hydrogen into the steel material. As a result, each of these elements increases the SSC resistance of the steel material.

Co: 0 to 0.50%

Cobalt (Co) is an optional element, and need not be contained. That is, the Co content may be 0%. If contained, in a sour environment Co forms a protective corrosion coating and suppresses the penetration of hydrogen into the steel material. By this means, Co enhances the SSC resistance of the steel material. If even a small amount of Co is contained, the aforementioned effect can be obtained to a certain extent. However, if the Co content is too high, hardenability of the steel material will decrease, and strength of the steel material will decrease, even when the contents of other elements are within the range of the present embodiment. Therefore, the Co content is within the range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and need not be contained. That is, the W content may be 0%. If contained, W forms a protective corrosion coating in a sour environment and suppresses hydrogen penetration into the steel material. Thereby, the SSC resistance of the steel material increases. If even a small amount of W is contained, the aforementioned effect can be obtained to a certain extent. However, if the W content is too high, coarse carbides form in the steel material, and low-temperature toughness and the SSC resistance of the steel material decrease, even when the contents of other elements are within the range of the present embodiment. Therefore, the W content is within the range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

The chemical composition of the steel material described above may further contain one or more types of element selected from the group consisting of Ni and Cu in lieu of a part of Fe. Each of these elements is an optional element, and increases hardenability of the steel material.

Ni: 0 to 0.50%

Nickel (Ni) is an optional element, and need not be contained. That is, the Ni content may be 0%. If contained, Ni enhances hardenability of the steel material and increases strength of the steel material. In addition, Ni dissolves in the steel and enhances low-temperature toughness of the steel material. If even a small amount of Ni is contained, the aforementioned effects can be obtained to a certain extent. However, if the Ni content is too high, the Ni will promote local corrosion, and the SSC resistance of the steel material will decrease, even when the contents of other elements are within the range of the present embodiment. Therefore, the Ni content is within the range of 0 to 0.50%. A preferable lower limit of the Ni content is more than 0%, more preferably is 0.01%, and further preferably is 0.02%. A preferable upper limit of the Ni content is 0.30%, more preferably is 0.20%, and further preferably is 0.10%.

Cu: 0 to 0.50%

Copper (Cu) is an optional element, and need not be contained. That is, the Cu content may be 0%. If contained, Cu enhances hardenability of the steel material and increases strength of the steel material. If even a small amount of Cu is contained, the aforementioned effects can be obtained to a certain extent. However, if the Cu content is too high, hardenability of the steel material will be too high, and the SSC resistance of the steel material will decrease, even when the contents of other elements are within the range of the present embodiment. Therefore, the Cu content is within the range of 0 to 0.50%. A preferable lower limit of the Cu content is more than 0%, more preferably is 0.01%, further preferably is 0.02%, and further preferably is 0.05%. A preferable upper limit of the Cu content is 0.35%, and more preferably is 0.25%.

[Regarding Formula (1)]

A steel material according to the present embodiment satisfies the following Formula (1).

$$27\times Mn+9\times Cr-14\times Mo-770\times C^2+760\times C-11\times Si^2+4\times Si>85 \quad (1)$$

Where, a content in mass % of a corresponding element is substituted for each symbol of an element in Formula (1).

Fn1 ($=27\times Mn+9\times Cr-14\times Mo-770\times C^2+760\times C-11\times Si^2+4\times Si$) is an index that indicates the balance between the dislocation density ρ and the yield strength $\sigma_{YS}$ in the aforementioned chemical composition having an Si content of 1.36% or more. In a steel material having the aforementioned chemical composition, if Fn1 is too low, the dislocation density ρ cannot be adequately reduced, and Fn2 that is described later will be 691 or less. On the other hand, if Fill is greater than 85, the dislocation density ρ can be reduced, and Fn2 that is described later will be more than 691. As a result, excellent SSC resistance can be obtained in a room-temperature sour environment and in a low-temperature sour environment. Therefore, in a steel material according to the present embodiment, in addition to having the aforementioned chemical composition, Fn1 is made more than 85. A preferable lower limit of Fn1 is 87, more preferably is 89, further preferably is 90, and more preferably is 91. Whilst the upper limit of Fn1 is not particularly limited, within the range of the chemical composition that is described above, the upper limit of Fn1 is practically 207.

[Regarding Formula (2)]

In a steel material according to the present embodiment, the dislocation density ρ and the yield strength $\sigma_{YS}$ satisfy the following Formula (2).

$$691<\sigma_{YS}-110\times\sqrt{\rho}\times10^{-7}\leq795 \quad (2)$$

Where, in Formula (2), a yield strength in MPa is substituted for $\sigma_{YS}$, and a dislocation density in $m^{-2}$ is substituted for ρ.

Fn2 ($=\sigma_{YS}-110\times\sqrt{\rho}10^{-7}$) is an index that indicates SSC resistance in a low-temperature sour environment. In a steel material having the aforementioned chemical composition, if Fn2 is more than 691, excellent SSC resistance can be obtained even in a low-temperature sour environment. In addition, in a steel material according to the present embodiment, the upper limit of Fn2 is practically 795 or less. Therefore, in a steel material according to the present embodiment, a requirement that Fn2 is within the range of more than 691 to 795 is satisfied. A preferable lower limit of Fn2 is 693, and more preferably is 694. A preferable upper limit of Fn2 is 790, and more preferably is 785.

A method for determining the yield strength $\sigma_{YS}$ of a steel material according to the present embodiment will be described later. The dislocation density ρ of a steel material according to the present embodiment can be determined by the following method. A test specimen for dislocation density measurement is prepared from the steel material according to the present embodiment. If the steel material is a steel plate, the test specimen is prepared from a center portion of the thickness. If the steel material is a steel pipe, the test specimen is prepared from a center portion of the wall thickness. If the steel material is a steel bar which has a circular cross-section, the test specimen is prepared from the R/2 portion. In the present description, an R/2 position means a center position of a radius R in a cross-section perpendicular to the axial direction of the steel bar. The size of the test specimen is, for example, 20 mm width×20 mm length×2 mm thickness. The thickness direction of the test specimen is the thickness direction of the steel material (plate thickness direction, wall thickness direction, or radius direction of the circular cross-section of the steel bar). In this case, the observation surface of the test specimen is a surface with dimensions of 20 mm width×20 mm length. The observation surface of the test specimen is mirror-polished, and furthermore electropolishing is performed using a 10 vol % perchloric acid (acetic acid solvent) solution to remove strain in the outer layer. The observation surface after the electropolishing is subjected to X-ray diffraction (XRD) to determine the half-value width ΔK of the peaks of the (110), (211) and (220) planes of the body-centered cubic structure (iron).

In the XRD, measurement of the half-value width ΔK is performed by employing CoKα rays as the radiation source, 30 kV as the tube voltage, and 100 mA as the tube current. In addition, $LaB_6$ (lanthanum hexaboride) powder is used in order to measure a half-value width originating from the X-ray diffractometer.

The heterogeneous strains of the test specimen is determined based on the half-value width ΔK determined by the aforementioned method and the Williamson-Hall equation (Formula (3)).

$$\Delta K\times\cos\theta/\lambda=0.9/D+2\varepsilon\times\sin\theta/\lambda \quad (3)$$

Where, in Formula (3), θ represents the diffraction angle, λ represents the wavelength of the X-ray, and D represents the crystallite diameter.

In addition, the dislocation density ρ ($m^{-2}$) can be determined using the obtained heterogeneous strain ε and Formula (4).

$$\rho=14.4\times\varepsilon^2/b^2 \quad (4)$$

Where, in Formula (4), b represents the Burgers vector (b=0.248 (nm)) of the body-centered cubic structure (iron).

Note that, in a steel material according to the present embodiment, the range of the dislocation density ρ is not particularly limited. In a steel material according to the present embodiment, it suffices that the dislocation density ρ satisfies Formula (2). Among the steel materials according to the present embodiment, for example, in a case where the yield strength $\sigma_{YS}$ of a steel material is 758 MPa or more, the dislocation density ρ in the steel material is $0.1\times10^{14}$ ($m^{-2}$) or more. Among the steel materials according to the present embodiment, for example, in a case where the yield strength $\sigma_{YS}$ of a steel material is 862 MPa or more, the dislocation density ρ in the steel material is $0.4\times10^{14}$ ($m^{-2}$) or more. Among the steel materials according to the present embodiment, for example, in a case where the yield strength $\sigma_{YS}$ of a steel material is 965 MPa or more, the dislocation density ρ in the steel material is $2.4\times10^{14}$ ($m^{-2}$) or more. Among the steel materials according to the present embodiment, for example, in a case where the yield strength $\sigma_{YS}$ of a steel material is less than 862 MPa, the dislocation density ρ in the steel material is less than $2.4\times10^{14}$ ($m^{-2}$). Among the steel materials according to the present embodiment, for example, in a case where the yield strength $\sigma_{YS}$ of a steel material is less than 965 MPa, the dislocation density ρ in the steel material is less than $6.2\times10^{14}$ ($m^{-2}$). Among the steel materials according to the present embodiment, for example, in a case where the yield strength $\sigma_{YS}$ of a steel material is 1069 MPa or less, the dislocation density ρ in the steel material is $11.8\times10^{14}$ ($m^{-2}$) or less. That is, in a case where the yield strength $\sigma_{YS}$ of a steel material is within the range of 758 to 1069 MPa, the dislocation density ρ of the steel material is within the range of $0.1\times10^{14}$ to $11.8\times10^{14}$ ($m^{-2}$).

[Yield Strength]

The yield strength $\sigma_{YS}$ of a steel material according to the present embodiment is 758 MPa or more. It suffices that the upper limit of the yield strength $\sigma_{YS}$ is caused to satisfy Fn2 in the relation with the dislocation density ρ, and the upper limit is not particularly limited. As used in the present description, the term "yield strength $\sigma_{YS}$" means 0.2% offset proof stress obtained in a tensile test. By having the aforementioned chemical composition including Formula (1), and by the dislocation density ρ and the yield strength $\sigma_{YS}$ satisfying Formula (2) described above, the steel material according to the present embodiment has excellent SSC resistance in a room-temperature sour environment and a low-temperature sour environment even when the yield strength $\sigma_{YS}$ is 758 MPa or more.

The yield strength $\sigma_{YS}$ of a steel material according to the present embodiment can be determined by the following method. Specifically, a tensile test is performed in conformity with ASTM E8/E8M (2013). A round bar test specimen is prepared from the steel material according to the present embodiment. If the steel material is a steel plate, the round bar test specimen is prepared from the center portion of the thickness. If the steel material is a steel pipe, the round bar test specimen is taken from the center portion of the wall thickness. If the steel material is a steel bar which has a circular cross-section, the round bar test specimen is taken from the R/2 portion. Regarding the size of the round bar test specimen, for example, the round bar test specimen has a parallel portion diameter of 4 mm and a gauge length of 20 mm. Note that the axial direction of the round bar test specimen is parallel to the rolling direction of the steel material. A tensile test is performed in the atmosphere at room temperature (25° C.) using the round bar test specimen, and obtained 0.2% offset proof stress is defined as the yield strength $\sigma_{YS}$ (MPa).

A preferable yield strength $\sigma_{YS}$ of a steel material according to the present embodiment is 758 MPa or more (110 ksi or more). That is, by having the aforementioned chemical composition including Formula (1), and by the dislocation density ρ and the yield strength $\sigma_{YS}$ satisfying Formula (2) described above, the steel material according to the present embodiment has excellent SSC resistance in a room-temperature sour environment and a low-temperature sour environment even when the steel material has a yield strength of 758 MPa or more (110 ksi or more). The upper limit of the yield strength $\sigma_{YS}$ of a steel material according to the present embodiment is not particularly limited and, for example, is 1069 MPa (155 ksi).

[Microstructure]

In the microstructure of the steel material according to the present embodiment, the total of the volume ratios of tempered martensite and tempered bainite is 90% or more. The balance of the microstructure is, for example, ferrite or pearlite. If the microstructure of the steel material having the aforementioned chemical composition contains tempered martensite and tempered bainite in an amount equivalent to a total volume ratio of 90% or more, on the condition that the other requirements according to the present embodiment are satisfied, excellent SSC resistance is exhibited in a room-temperature sour environment and a low-temperature sour environment. That is, in the present embodiment, if the steel material has excellent SSC resistance, it can be determined that the total of the volume ratios of tempered martensite and tempered bainite in the microstructure is 90% or more.

Note that, the following method can be adopted in the case of determining the volume ratio of tempered martensite and tempered bainite by observation. First, a test specimen is prepared from the steel material. In a case where the steel material is a steel plate, a test specimen having an observation surface with dimensions of 10 mm in the rolling direction and 10 mm in the thickness direction is prepared from a center portion of the thickness. Note that, in the case of a steel plate in which the thickness of the steel material is less than 10 mm, a test specimen having an observation surface with dimensions of 10 mm in the rolling direction and the thickness of the steel plate in the plate thickness direction is cut out. In a case where the steel material is a steel pipe, a test specimen having an observation surface with dimensions of 10 mm in the pipe axis direction and 8 mm in the wall thickness (pipe radius) direction is prepared from a center portion of the wall thickness. Note that, in the case of a steel pipe in which the wall thickness of the steel material is less than 10 mm, a test specimen having an observation surface with dimensions of 10 mm in the pipe axis direction and the wall thickness of the steel pipe in the pipe radius direction is cut out.

After polishing the observation surface of the test specimen to obtain a mirror surface, the test specimen is immersed for about 10 seconds in a nital etching reagent, to reveal the microstructure by etching. The etched observation surface is observed by performing observation with respect to 10 visual fields by means of a secondary electron image obtained using a scanning electron microscope (SEM). The visual field area is, for example, 400 $\mu m^2$ (magnification of ×5000). In each visual field, tempered martensite and tempered bainite are identified based on the contrast. The area fractions of the identified tempered martensite and tempered bainite are determined. The method of the measurement of the area fractions will not be particularly limited and a well-known method can be used. For example, the area fractions of tempered martensite and tempered bainite can be determined by performing the image processing. In the present embodiment, the arithmetic average value of the area fractions of tempered martensite and tempered bainite determined in all of the visual fields is defined as the volume ratio of tempered martensite and tempered bainite.

[Prior-Austenite Grain Diameter]

In the microstructure of the steel material according to the present embodiment, the prior-austenite grain diameter (prior-γ grain diameter) is not particularly limited. Normally, in a steel material, if prior-γ grains are fine, yield strength and SSC resistance consistently increase. Therefore, it is preferable that the prior-γ grains are fine. On the other hand, in the steel material according to the present embodiment, as mentioned above, the Si content in the chemical composition is increased to 1.36% or more. As a result, there is a tendency for prior-γ grains to easily become coarse in the microstructure of the steel material.

In this regard, in a preferable production method to be described later, if prior-γ grains in a steel material after quenching (intermediate steel material) become coarse, in some cases the dislocation density ρ cannot be adequately reduced in a subsequent tempering process. Therefore, in the steel material according to the present embodiment, a preferable prior-γ grain diameter in the microstructure is 35 μm or less. A further preferable upper limit of the prior-γ grain diameter is 33 μm, more preferably is 31 μm, and more preferably is 30 μm. Note that, in the steel material according to the present embodiment, preferably the prior-γ grains in the microstructure are fine. Accordingly, in the steel material according to the present embodiment, a lower limit of the prior-γ grain diameter in the microstructure is not particularly limited. In the steel material according to the present embodiment, the lower limit of the prior-γ grain diameter in the microstructure is, for example, 5 μm.

In the present embodiment, the prior-γ grain diameter can be determined by the following method. If the steel material is a steel plate, a test specimen having an observation surface with dimensions of 10 mm in the rolling direction and 10 mm in the plate thickness direction is cut out from a center portion of the thickness. Note that, in the case of a steel plate in which the thickness of the steel material is less than 10 mm, a test specimen having an observation surface with dimensions of 10 mm in the rolling direction and the thickness of the steel plate in the plate thickness direction is cut out. If the steel material is a steel pipe, a test specimen having an observation surface with dimensions of 10 mm in the pipe axis direction and 10 mm in the pipe radius direction is cut out from a center portion of the wall thickness. Note that, in the case of a steel pipe in which the wall thickness of the steel material is less than 10 mm, a test specimen having an observation surface with dimensions of 10 mm in the pipe axis direction and the wall thickness of the steel pipe in the pipe radius direction is cut out. If the steel material is a steel bar which has a circular cross-section, a test specimen having an observation surface, which includes an R/2 portion as center portion, with dimensions of 10 mm in the axial direction and 10 mm in the radial direction of the circular cross-section is cut out. Note that, in the case of a steel bar in which the diameter of the circular cross-section is less than 10 mm, a test specimen having an observation surface, which includes an R/2 portion, with dimensions of 10 mm in the axial direction and the diameter in the radial direction of the circular cross-section is cut out.

After embedding the test specimen in resin and polishing the observation surface to obtain a mirror surface, the test specimen is immersed for about 60 seconds in an aqueous solution saturated with picric acid to reveal prior-γ grain boundaries by etching. The etched observation surface is observed by performing observation with respect to 10 visual fields by means of a secondary electron image obtained using an SEM, and photographic images are generated. The areas of the respective prior-γ grains are determined based on the generated photographic images, and the equivalent circular diameter of each of the prior-γ grains is determined based on the thus-determined area. An arithmetic average value of the equivalent circular diameters of the prior-γ grains that are determined in the 10 visual fields is defined as the prior-γ grain diameter (μm).

[Shape of Steel Material]

The shape of the steel material according to the present embodiment is not particularly limited. The steel material is, for example, a steel pipe or a steel plate. The steel material may also be a solid material (steel bar). In a case where the steel material is an oil-well steel pipe, a preferable wall thickness is 9 to 60 mm. More preferably, the steel material according to the present embodiment is a seamless steel pipe. In a case where the steel material according to the present embodiment is a seamless steel pipe, even if the seamless steel pipe has a thick wall with a wall thickness of 15 mm or more, the seamless steel pipe has excellent SSC resistance in a room-temperature sour environment and a low-temperature sour environment.

[SSC Resistance of Steel Material]

The SSC resistance of the steel material according to the present embodiment can be evaluated by a room-temperature SSC resistance test and a low-temperature SSC resistance test. The room-temperature SSC resistance test and the low-temperature SSC resistance test are each performed by a method in accordance with "Method A" specified in NACE TM0177-2005.

[SSC Resistance when Yield Strength is 758 to Less than 862 MPa]

In the room-temperature SSC resistance test, a mixed aqueous solution containing 5.0 mass % of sodium chloride and 0.5 mass % of acetic acid (NACE solution A) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 95% of the actual yield stress is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held at 24° C. for 720 hours.

On the other hand, in the low-temperature SSC resistance test, a mixed aqueous solution containing 5.0 mass % of sodium chloride and 0.5 mass % of acetic acid (NACE solution A) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 90% of the actual yield stress is applied to the round bar test specimen. The test solution at 4° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held at 4° C. for 720 hours.

In a case where the steel material according to the present embodiment has a yield strength of 758 to less than 862 MPa, cracking is not confirmed after 720 hours elapse in each of a room-temperature SSC resistance test conducted under the aforementioned conditions and a low-temperature SSC resistance test conducted under the aforementioned conditions. Note that, in the present description, the phrase "cracking is not confirmed" means that cracking is not confirmed in a test specimen in a case where the test specimen after the test was observed by the naked eye and by means of a projector with a magnification of ×10.

[SSC Resistance when Yield Strength is 862 to Less than 965 MPa]

In the room-temperature SSC resistance test, a mixed aqueous solution containing 5.0 mass % of sodium chloride and 0.5 mass % of acetic acid (DACE solution A) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 95% of the actual yield stress is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held at 24° C. for 720 hours.

On the other hand, in the low-temperature SSC resistance test, a mixed aqueous solution containing 5.0 mass % of sodium chloride and 0.5 mass % of acetic acid (MACE solution A) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 85% of the actual yield stress is applied to the round bar test specimen. The test solution at 4° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held at 4° C. for 720 hours.

In a case where the steel material according to the present embodiment has a yield strength of 862 to less than 965 MPa, cracking is not confirmed after 720 hours elapse in each of a room-temperature SSC resistance test conducted under the aforementioned conditions and a low-temperature SSC resistance test conducted under the aforementioned conditions.

[SSC Resistance when Yield Strength is 965 MPa or More]

In the room-temperature SSC resistance test, a mixed aqueous solution containing 5.0 mass % of sodium chloride and 0.4 mass % of sodium acetate that is adjusted to pH 3.5 using acetic acid (NACE solution B) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 95% of the actual yield stress is applied to the round bar test specimen. The test solution at 24° C. is poured into a test vessel so that the round bar test specimen to which the stress has been applied is immersed therein, and this is adopted as a test bath. After degassing the test bath, a mixed gas of $H_2S$ gas at 0.1 atm pressure and $CO_2$ gas at 0.9 atm pressure is blown into the test bath and is caused to saturate in the test bath. The test bath into which the mixed gas of $H_2S$ gas at 0.1 atm pressure and $CO_2$ gas at 0.9 atm pressure was blown is held at 24° C. for 720 hours.

On the other hand, in the low-temperature SSC resistance test, a mixed aqueous solution containing 5.0 mass % of sodium chloride and 0.4 mass % of sodium acetate that is adjusted to pH 3.5 using acetic acid (NACE solution B) is employed as the test solution. A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. If the steel material is a steel bar which has a circular cross-section, the round bar test specimen is taken from the R/2 portion. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 85% of 965 MPa (i.e. 820 MPa) is applied to the round bar test specimen. The test solution at 4° C. is poured into a test vessel so that the round bar test specimen to which the stress has been applied is immersed therein, and this is adopted as a test bath. After degassing the test bath, a mixed gas of $H_2S$ gas at 0.1 atm pressure and $CO_2$ gas at 0.9 atm pressure is blown into the test bath and is caused to saturate in the test bath. The test bath into which the mixed gas of $H_2S$ gas at 0.1 atm pressure and $CO_2$ gas at 0.9 atm pressure was blown is held at 4° C. for 720 hours.

In a case where the steel material according to the present embodiment has a yield strength of 965 MPa or more, cracking is not confirmed after 720 hours elapse in each of a room-temperature SSC resistance test conducted under the aforementioned conditions and a low-temperature SSC resistance test conducted under the aforementioned conditions.

[Production Method]

A method for producing the steel material according to the present embodiment will now be described. The production method described hereunder is a method for producing a seamless steel pipe as one example of the steel material according to the present embodiment. The method for producing a seamless steel pipe includes a process of preparing a hollow shell (preparation process), and a process of subjecting the hollow shell to quenching and tempering to form a seamless steel pipe (quenching process and tempering process). Note that, a production method according to the present embodiment is not limited to the production method described hereunder. Each process is described in detail hereunder.

[Preparation Process]

In the preparation process, an intermediate steel material having the aforementioned chemical composition is prepared. As long as the intermediate steel material has the aforementioned chemical composition, the method for producing the intermediate steel material is not particularly limited. As used here, the term "intermediate steel material" refers to a plate-shaped steel material in a case where the end product is a steel plate, and refers to a hollow shell in a case where the end product is a steel pipe.

The preparation process may include a process in which a starting material is prepared (starting material preparation process), and a process in which the starting material is subjected to hot working to produce an intermediate steel material (hot working process). Hereunder, a case in which the preparation process includes the starting material preparation process and the hot working process is described in detail.

[Starting Material Preparation Process]

In the starting material preparation process, a starting material is produced using molten steel having the aforementioned chemical composition. The method for producing the starting material is not particularly limited, and a well-known method can be used. Specifically, a cast piece (a slab, bloom or billet) may be produced by a continuous casting process using the molten steel. An ingot may also be produced by an ingot-making process using the molten steel. As necessary, the slab, bloom or ingot may be subjected to blooming to produce a billet. The starting material (a slab, bloom or billet) is produced by the above described process.

[Hot Working Process]

In the hot working process, the starting material that was prepared is subjected to hot working to produce an intermediate steel material. In a case where the steel material is a seamless steel pipe, the intermediate steel material corresponds to a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell (seamless steel pipe). The method of performing the hot working is not particularly limited, and a well-known method can be used.

For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by performing another hot working method. For example, in the case of a heavy-wall steel material of a short length such as a coupling, a hollow shell may be produced by forging by the Ehrhardt process or the like. A hollow shell is produced by the above process. Although not particularly limited, the wall thickness of the hollow shell is, for example, 9 to 60 mm.

The hollow shell produced by hot working may be air-cooled (as-rolled). The hollow shell produced by hot working may be subjected to direct quenching after hot working without being cooled to room temperature, or may be subjected to quenching after undergoing supplementary heating (reheating) after hot working.

In a case of performing direct quenching after hot working, or performing quenching after supplementary heating, cooling may be stopped midway through the quenching process or slow cooling may be performed. In this case, the occurrence of quench cracking in the hollow shell can be suppressed. In addition, in the case of performing direct quenching after hot working, or performing quenching after supplementary heating, a stress relief annealing (SR) may be performed at a time that is after quenching and before the heat treatment of the next process. In this case, residual stress of the hollow shell is eliminated.

As described above, an intermediate steel material is prepared in the preparation process. The intermediate steel material may be produced by the aforementioned preferable process, or may be an intermediate steel material that was produced by a third party, or an intermediate steel material that was produced in another factory other than the factory in which a quenching process and a tempering process that are described later are performed, or at a different works. The quenching process is described in detail hereunder.

[Quenching Process]

In the quenching process, the intermediate steel material (hollow shell) that was prepared is subjected to quenching. In the present description, the term "quenching" means rapidly cooling the intermediate steel material that is at a temperature not less than the $A_3$ point. In the present description, the temperature of the intermediate steel material immediately prior to rapid cooling when quenching is performed is also referred to as "quenching temperature". That is, in the present description, in a case where direct quenching is performed after hot working, the term "quenching temperature" corresponds to the surface temperature of the intermediate steel material that is measured by a thermometer placed on the exit side of the apparatus that performs the final hot working. Further, in a case where quenching is performed after supplementary heating or reheating after hot working, the term "quenching temperature" corresponds to the temperature of the furnace that performs the supplementary heating or reheating.

In addition, in the present description, the $A_{c3}$ point and the $A_{r3}$ point are also collectively referred to as "$A_3$ point". In this regard, in the case of performing direct quenching after hot working, the intermediate steel material is rapidly cooled from a quenching temperature of the $A_{r3}$ point or more. On the other hand, in a case where an intermediate steel material cooled after hot working is reheated and subjected to quenching, the intermediate steel material is rapidly cooled from a quenching temperature of the $A_{c3}$ point or more.

In the present embodiment, the Si content is increased and the dislocation density ρ of the steel material is reduced. On the other hand, in a case where the Si content is simply increased, the $A_3$ point of the steel material may become too high. If the $A_3$ point of the steel material is too high, there is no choice but to raise the quenching temperature, and consequently the prior-γ grains coarsen. In the intermediate steel material after quenching, if the prior-γ grains coarsen, in a tempering process that is described later, the dislocation density ρ cannot be adequately reduced. As a result, the dislocation density ρ and the yield strength $\sigma_{YS}$ cannot satisfy Formula (2), and the SSC resistance of the steel material decreases.

On the other hand, as mentioned above, in the chemical composition of the steel material according to the present embodiment, Fn1 is an index of the $A_3$ point. If Fn1 is more than 85, the occurrence of a situation in which the $A_3$ point becomes too high can be suppressed. Consequently, since there is no longer a necessity to make the quenching temperature too high, coarsening of prior-γ grains can be suppressed. As a result, by performing preferable tempering in a tempering process to be described later, in the steel material after the tempering process that is described later, the dislocation density ρ and the yield strength $\sigma_{YS}$ can satisfy Formula (2).

In a quenching process according to the present embodiment, a preferable quenching temperature is within a range of 860 to 1000° C. If the quenching temperature is too low, the effect of quenching will not be sufficiently obtained, and the mechanical properties defined in the present embodiment cannot be obtained in the produced steel material. On the other hand, if the quenching temperature is too high, prior-γ grains will coarsen as mentioned above, and the SSC resistance in the produced steel material will decrease. In the present embodiment, a more preferable upper limit of the quenching temperature is 995° C., and further preferably is 990° C. In the present embodiment, a more preferable lower limit of the quenching temperature is 880° C., and further preferably is 900° C.

The quenching method, for example, continuously cools the intermediate steel material (hollow shell) from the quenching starting temperature, and continuously decreases the surface temperature of the hollow shell. The method of performing the continuous cooling treatment is not particularly limited, and a well-known method can be used. The method of performing the continuous cooling treatment is, for example, a method that cools the hollow shell by immersing the hollow shell in a water bath, or a method that cools the hollow shell in an accelerated manner by shower water cooling or mist cooling.

If the cooling rate during quenching is too slow, the microstructure does not become one that is principally composed of martensite and bainite, and the mechanical properties defined in the present embodiment cannot be obtained. In this case, in addition, excellent low-temperature toughness and excellent SSC resistance are not obtained.

Therefore, as described above, in the method for producing the steel material according to the present embodiment, the intermediate steel material is rapidly cooled during quenching. Specifically, in the quenching process, the average cooling rate when the surface temperature of the intermediate steel material (hollow shell) is within the range of 800 to 500° C. during quenching is defined as a cooling rate during quenching $CR_{800\text{-}500}$. More specifically, the cooling rate during quenching $CR_{800\text{-}500}$ is determined based on a temperature that is measured at a region that is most slowly cooled within a cross-section of the intermediate steel material that is being quenched (for example, in the case of forcedly cooling both surfaces, the cooling rate is measured at the center portion of the thickness of the intermediate steel material).

A preferable cooling rate during quenching $CR_{800\text{-}500}$ is 300° C./min or higher. A more preferable lower limit of the cooling rate during quenching $CR_{800\text{-}500}$ is 450° C./min, and further preferably is 600° C./min. Although an upper limit of the cooling rate during quenching $CR_{800\text{-}500}$ is not particularly defined, the upper limit is for example, 60000° C./min.

Preferably, quenching is performed after performing heating of the hollow shell in the austenite zone a plurality of times. In this case, the SSC resistance of the steel material increases because austenite grains are refined prior to quenching. Heating in the austenite zone may be repeated a plurality of times by performing quenching a plurality of times, or heating in the austenite zone may be repeated a plurality of times by performing normalizing and quenching. Further, quenching and tempering that is described later may be performed in combination a plurality of times. That is, quenching and tempering may be performed a plurality of times. In this case, the SSC resistance of the steel material increases further. The tempering process is described in detail hereunder.

[Tempering Process]

The tempering process is carried out by performing tempering after performing the aforementioned quenching. In the present description, the term "tempering" means reheating the intermediate steel material after quenching to a temperature that is not more than the $A_{c1}$ point and holding the intermediate steel material at that temperature. The tempering temperature is appropriately adjusted in accordance with the chemical composition of the steel material and the yield strength to be obtained. That is, the tempering temperature is adjusted for the intermediate steel material (hollow shell) which has the chemical composition of the present embodiment, so that the yield strength of the steel material is adjusted to, for example, 758 MPa or more (110 ksi or more). Here, the tempering temperature corresponds to the temperature of the furnace when the intermediate steel material after quenching is heated and held at the relevant temperature. The tempering time means the period of time from the temperature of the intermediate steel material reaching a predetermined tempering temperature till the extracting from the heat treatment furnace.

Normally, in the case of producing a steel material that is to be used for oil wells, in order to increase the SSC resistance, the dislocation density is reduced by increasing the tempering temperature as high as the range of 600 to 730° C. However, in this case, alloy carbides finely disperse when the steel material is being held for tempering. Because the finely dispersed alloy carbides act as obstacles to the movement of dislocations, the finely dispersed alloy carbides suppress recovery of dislocations (that is, annihilation of the dislocations). Therefore, in the case of performing only tempering at a high temperature for reducing the dislocation density, the dislocation density cannot be adequately reduced in some cases.

Therefore, the steel material according to the present embodiment is subjected to tempering at a low temperature to thereby reduce the dislocation density to a certain extent in advance. In addition, tempering at a high temperature is performed and the dislocation density is further reduced. That is, in the tempering process according to the present embodiment, tempering is performed in two stages, in the order of low-temperature tempering and high-temperature tempering. According to this method, the dislocation density can be reduced while maintaining the yield strength. In short, by performing tempering in two stages, the dislocation density $\rho$ and the yield strength $\sigma_{YS}$ can satisfy Formula (2). Hereunder, the low-temperature tempering process and high-temperature tempering process are described in detail.

[Low-Temperature Tempering Process]

In the low-temperature tempering process, a preferable tempering temperature is within the range of 100 to 550° C. If the tempering temperature in the low-temperature tempering process is too high, alloy carbides will finely disperse while the steel material is being held at the tempering temperature during tempering, and in some cases the dislocation density $\rho$ cannot be adequately reduced and the SSC resistance of the steel material decreases. On the other hand, if the tempering temperature in the low-temperature tempering process is too low, in some cases the dislocation density $\rho$ cannot be reduced while the steel material is being held at the tempering temperature during tempering, and the SSC resistance of the steel material decreases. Therefore, it is preferable to set the tempering temperature in the low-temperature tempering process within the range of 100 to 550° C. A more preferable lower limit of the tempering temperature in the low-temperature tempering process is 200° C. A more preferable upper limit of the tempering temperature in the low-temperature tempering process is 500° C.

In the low-temperature tempering process, a preferable holding time for tempering (tempering time) is within the range of 10 to 90 minutes. If the tempering time in the low-temperature tempering process is too short, in some cases the dislocation density cannot be adequately reduced and the SSC resistance of the steel material decreases. On the other hand, if the tempering time in the low-temperature tempering process is too long, the aforementioned effects are saturated. Accordingly, in the present embodiment the tempering time is preferably set within the range of 10 to 90 minutes. A more preferable upper limit of the tempering time is 80 minutes. Note that, in a case where the steel material is a steel pipe, in comparison to other shapes, temperature variations with respect to the steel pipe are liable to occur during holding for tempering. Therefore, in a case where the steel material is a steel pipe, the tempering time is preferably set within a range of 15 to 90 minutes.

[High-Temperature Tempering Process]

In the high-temperature tempering process, the dislocation density ρ is further reduced by performing tempering at a higher temperature than in the low-temperature tempering process. In this case, if prior-γ grains become too coarse in the intermediate steel material during the high-temperature tempering process, in some cases the dislocation density ρ cannot be adequately reduced. Firstly, it is considered that there are many cases where recovery of dislocations (that is, annihilation of dislocations) occurs as a result of merging of dislocation pairs of opposite sign or dislocations being absorbed to high-angle grain boundaries (grain boundaries having an orientation difference of 15° or more) that correspond to block boundaries of lath martensite. On the other hand, if the prior-γ grains are too coarse, the block diameter will simultaneously become large, and the length of a dislocation line will be long. In this case, as mentioned above, when high-temperature tempering is performed, alloy carbides will finely disperse when the steel material is being held at a high temperature. If the length of a dislocation line is long, the dislocation will come in more contact with alloy carbides that act as obstacles during movement of the dislocation. Consequently, it will become difficult for dislocations to move. It is considered that, as a result, merging of dislocation pairs of opposite sign or absorption of dislocations to high-angle grain boundaries is suppressed, and thus recovery of dislocations is suppressed. It is estimated that this kind of influence of the prior-γ grain diameter can occur in a similar manner even in a low-temperature tempering process if cementite or e carbides precipitate within blocks. Note that, it is also possible that there is a possibility that the dislocation density ρ cannot be adequately reduced in a case where the prior-γ grains are coarse due to another mechanism. However, if the production method according to the present embodiment is executed with respect to an intermediate steel material having the aforementioned chemical composition, the dislocation density ρ is adequately reduced and the dislocation density ρ and the yield strength $\sigma_{YS}$ can be made to satisfy Formula (2).

In the high-temperature tempering process, a preferable tempering temperature is within the range of 580 to 740° C. If the tempering temperature in the high-temperature tempering process is too high, in some cases the dislocation density may be reduced too much and the desired yield strength cannot be obtained. Furthermore, if the tempering temperature in the high-temperature tempering process is too high, in some cases austenite will form in the microstructure and a microstructure that is principally composed of martensite and bainite cannot be obtained. In such a case, SSC resistance of the steel material cannot be obtained. On the other hand, if the tempering temperature in the high-temperature tempering process is too low, in some cases the dislocation density cannot be adequately reduced, and the SSC resistance of the steel material decreases. Therefore, a preferable tempering temperature in the high-temperature tempering process is within a range of 580 to 740° C. A more preferable lower limit of the tempering temperature in the high-temperature tempering process is 600° C., and further preferably is 610° C. A more preferable upper limit of the tempering temperature in the high-temperature tempering process is 730° C., and further preferably is 720° C.

A preferable tempering time in the high-temperature tempering process is within a range of 10 to 180 minutes. If the tempering time is too short, in some cases the dislocation density cannot be adequately reduced, and the SSC resistance of the steel material decreases. On the other hand, if the tempering time is too long, the aforementioned effects are saturated. Therefore, in the present embodiment, a preferable tempering time is within the range of 10 to 180 minutes. A more preferable upper limit of the tempering time is 120 minutes, and further preferably is 90 minutes. Note that in a case where the steel material is a steel pipe, as mentioned above, temperature variations are liable to occur. Therefore, when the steel material is a steel pipe, the tempering time is preferably set within the range of 15 to 180 minutes.

Note that, the aforementioned low-temperature tempering process and high-temperature tempering process can be performed as consecutive heat treatments. That is, after performing the aforementioned holding for tempering in the low-temperature tempering process, next, the high-temperature tempering process may be performed in a successive manner by heating the steel material. At this time, the low-temperature tempering process and the high-temperature tempering process may be performed within the same heat treatment furnace.

On the other hand, the aforementioned low-temperature tempering process and high-temperature tempering process can also be performed as non-consecutive heat treatments. That is, after performing the aforementioned holding for tempering in the low-temperature tempering process, the steel material may be cooled to a lower temperature than the aforementioned tempering temperature, and thereafter heated again to perform the high-temperature tempering process. Even in this case, the effects obtained by the low-temperature tempering process and high-temperature tempering process are not impaired, and the steel material according to the present embodiment can be produced.

The steel material according to the present embodiment can be produced by the production method that is described above. Note that, a method for producing a steel pipe has been described as one example of the aforementioned production method. However, the steel material according to the present embodiment may be a steel plate or another shape. A method for producing a steel plate or a steel material of another shape also includes, for example, a preparation process, a quenching process and a tempering process, similarly to the production method described above. In addition, the aforementioned production method is one example, and the steel material according to the present embodiment may also be produced by another production method.

Hereunder, the present invention is described more specifically by way of examples.

Example 1

In Example 1, steel material having a yield strength of 110 ksi grade (758 to less than 862 MPa) was investigated. Specifically, molten steels of a weight of 180 kg having the chemical compositions shown in Table 1 were produced. Note that, "-" in Table 1 means that the content of the corresponding element was at the level of an impurity. Further, Fn1 that was determined based on the chemical composition described in Table 1 and the aforementioned definition is shown in Table 1.

TABLE 1

| Test | Chemical composition (in mass %, balance being Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 1-1 | 0.27 | 1.59 | 0.21 | 0.007 | 0.0008 | 0.053 | 0.73 | 0.83 | 0.21 | 0.014 | 0.0013 | 0.0045 |
| 1-2 | 0.29 | 1.92 | 0.12 | 0.012 | 0.0008 | 0.032 | 0.68 | 0.87 | 0.23 | 0.014 | 0.0014 | 0.0041 |
| 1-3 | 0.28 | 1.99 | 0.10 | 0.012 | 0.0006 | 0.033 | 0.83 | 0.81 | 0.17 | 0.014 | 0.0011 | 0.0044 |
| 1-4 | 0.32 | 2.66 | 0.53 | 0.006 | 0.0010 | 0.044 | 0.71 | 0.74 | 0.31 | 0.010 | 0.0013 | 0.0042 |
| 1-5 | 0.36 | 2.62 | 0.47 | 0.008 | 0.0006 | 0.041 | 0.78 | 0.82 | 0.16 | 0.010 | 0.0013 | 0.0030 |
| 1-6 | 0.35 | 2.33 | 0.38 | 0.008 | 0.0008 | 0.033 | 0.98 | 0.94 | 0.14 | 0.013 | 0.0014 | 0.0023 |
| 1-7 | 0.29 | 1.41 | 0.14 | 0.008 | 0.0007 | 0.025 | 0.72 | 0.75 | 0.34 | 0.012 | 0.0013 | 0.0040 |
| 1-8 | 0.33 | 2.72 | 0.35 | 0.008 | 0.0010 | 0.027 | 0.79 | 0.68 | 0.25 | 0.009 | 0.0013 | 0.0047 |
| 1-9 | 0.36 | 2.37 | 0.13 | 0.010 | 0.0007 | 0.038 | 0.70 | 0.88 | 0.18 | 0.010 | 0.0012 | 0.0042 |
| 1-10 | 0.33 | 2.32 | 0.39 | 0.008 | 0.0006 | 0.048 | 0.78 | 0.70 | 0.34 | 0.013 | 0.0014 | 0.0041 |
| 1-11 | 0.36 | 1.54 | 0.28 | 0.012 | 0.0009 | 0.025 | 0.85 | 0.75 | 0.11 | 0.015 | 0.0015 | 0.0031 |
| 1-12 | 0.31 | 1.44 | 0.11 | 0.009 | 0.0006 | 0.035 | 1.03 | 0.86 | 0.33 | 0.013 | 0.0012 | 0.0029 |
| 1-13 | 0.36 | 2.69 | 0.25 | 0.006 | 0.0006 | 0.039 | 1.04 | 0.69 | 0.22 | 0.013 | 0.0013 | 0.0036 |
| 1-14 | 0.33 | 2.85 | 0.26 | 0.012 | 0.0010 | 0.051 | 0.74 | 0.79 | 0.13 | 0.010 | 0.0015 | 0.0044 |
| 1-15 | 0.29 | 2.31 | 0.37 | 0.011 | 0.0009 | 0.042 | 0.84 | 0.82 | 0.18 | 0.012 | 0.0011 | 0.0025 |
| 1-16 | 0.34 | 2.66 | 0.51 | 0.007 | 0.0008 | 0.053 | 0.63 | 0.65 | 0.09 | 0.014 | 0.0013 | 0.0034 |
| 1-17 | 0.34 | 0.67 | 0.46 | 0.008 | 0.0009 | 0.025 | 0.80 | 0.76 | 0.34 | 0.010 | 0.0011 | 0.0045 |
| 1-18 | 0.25 | 1.21 | 0.30 | 0.009 | 0.0007 | 0.046 | 0.75 | 0.61 | 0.14 | 0.015 | 0.0012 | 0.0040 |
| 1-19 | 0.31 | 2.31 | 0.29 | 0.007 | 0.0007 | 0.031 | 0.03 | 0.78 | 0.07 | 0.014 | 0.0012 | 0.0044 |
| 1-20 | 0.34 | 1.97 | 0.14 | 0.011 | 0.0010 | 0.029 | 0.69 | 0.04 | 0.09 | 0.010 | 0.0015 | 0.0024 |
| 1-21 | 0.36 | 1.66 | 1.74 | 0.007 | 0.0008 | 0.037 | 0.99 | 0.67 | 0.33 | 0.012 | 0.0015 | 0.0023 |
| 1-22 | 0.29 | 2.37 | 0.37 | 0.008 | 0.0007 | 0.056 | 0.79 | 0.71 | 0.22 | 0.013 | 0.0014 | 0.0332 |
| 1-23 | 0.30 | 1.80 | 0.26 | 0.047 | 0.0008 | 0.048 | 0.67 | 0.90 | 0.29 | 0.009 | 0.0015 | 0.0042 |
| 1-24 | 0.27 | 1.88 | 0.33 | 0.010 | 0.0010 | 0.044 | 0.76 | 0.79 | — | 0.011 | 0.0011 | 0.0031 |
| 1-25 | 0.27 | 2.78 | 0.40 | 0.009 | 0.0007 | 0.033 | 0.64 | 0.83 | 0.13 | 0.013 | 0.0013 | 0.0030 |
| 1-26 | 0.25 | 2.49 | 0.14 | 0.010 | 0.0006 | 0.043 | 0.62 | 1.14 | 0.22 | 0.010 | 0.0015 | 0.0037 |
| 1-27 | 0.27 | 2.61 | 0.38 | 0.012 | 0.0008 | 0.055 | 0.67 | 0.30 | 0.10 | 0.015 | 0.0011 | 0.0047 |
| 1-28 | 0.30 | 2.56 | 1.23 | 0.006 | 0.0006 | 0.052 | 0.81 | 0.63 | 0.25 | 0.011 | 0.0013 | 0.0040 |
| 1-29 | 0.30 | 2.29 | 0.47 | 0.007 | 0.0006 | 0.035 | 0.74 | 0.67 | 0.17 | 0.078 | 0.0015 | 0.0035 |
| 1-30 | 0.31 | 2.19 | 0.56 | 0.009 | 0.0007 | 0.033 | 0.62 | 0.75 | 0.29 | 0.012 | 0.0013 | 0.0042 |

| Test | Chemical composition (in mass %, balance being Fe and impurities) | | | | | | | | | | |
|---|---|---|---|---|---|---|---|---|---|---|---|
| Number | O | Nb | Ca | Mg | Zr | Nd | Co | W | Ni | Cu | Fn1 |
| 1-1 | 0.0008 | — | — | — | — | — | — | — | — | — | 128 |
| 1-2 | 0.0019 | 0.008 | — | — | — | — | — | — | — | — | 120 |
| 1-3 | 0.0012 | — | — | — | — | — | — | — | — | — | 116 |
| 1-4 | 0.0011 | 0.010 | — | — | — | — | — | — | — | — | 108 |
| 1-5 | 0.0007 | — | 0.0020 | — | — | — | — | — | — | — | 117 |
| 1-6 | 0.0014 | — | — | 0.0018 | — | — | — | — | — | — | 127 |
| 1-7 | 0.0014 | — | — | — | 0.0016 | — | — | — | — | — | 139 |
| 1-8 | 0.0012 | — | — | — | — | 0.0023 | — | — | — | — | 103 |
| 1-9 | 0.0018 | — | — | — | — | — | 0.32 | — | — | — | 119 |
| 1-10 | 0.0006 | — | — | — | — | — | — | 0.34 | — | — | 125 |
| 1-11 | 0.0006 | — | — | — | — | — | — | — | 0.06 | — | 159 |
| 1-12 | 0.0007 | — | — | — | — | — | — | — | — | 0.22 | 145 |
| 1-13 | 0.0019 | — | — | — | — | — | — | — | — | — | 111 |
| 1-14 | 0.0019 | — | — | — | — | — | — | — | — | — | 92 |
| 1-15 | 0.0013 | — | — | — | — | — | — | — | — | — | 112 |
| 1-16 | 0.0012 | — | — | — | — | — | — | — | — | — | 113 |
| 1-17 | 0.0017 | — | — | — | — | — | — | — | — | — | 176 |
| 1-18 | 0.0011 | — | — | — | — | — | — | — | — | — | 137 |
| 1-19 | 0.0015 | — | — | — | — | — | — | — | — | — | 109 |
| 1-20 | 0.0008 | — | — | — | — | — | — | — | — | — | 144 |
| 1-21 | 0.0014 | — | — | — | — | — | — | — | — | — | 197 |
| 1-22 | 0.0009 | — | — | — | — | — | — | — | — | — | 110 |
| 1-23 | 0.0015 | — | — | — | — | — | — | — | — | — | 131 |
| 1-24 | 0.0010 | — | — | — | — | — | — | — | — | — | 122 |
| 1-25 | 0.0012 | — | — | — | — | — | — | — | — | — | 80 |
| 1-26 | 0.0013 | — | — | — | — | — | — | — | — | — | 77 |
| 1-27 | 0.0006 | — | — | — | — | — | — | — | — | — | 97 |
| 1-28 | 0.0010 | — | — | — | — | — | — | — | — | — | 129 |
| 1-29 | 0.0007 | — | — | — | — | — | — | — | — | — | 120 |
| 1-30 | 0.0012 | 0.053 | — | — | — | — | — | — | — | — | 128 |

Figure 3:
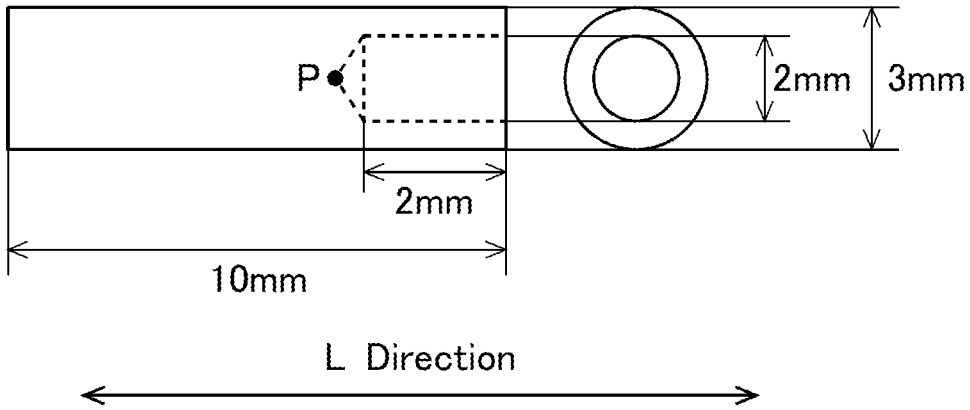
FIG. 3 is a side view of a test specimen used when determining an $A_{c3}$ point in the present examples.

Ingots were produced using the molten steels described above. The ingots were hot rolled to produce steel plates having a plate thickness of 15 mm. After hot rolling, the steel plate of each of Test Numbers 1-1 to 1-30 whose steel plate temperature was made room temperature was subjected to quenching twice. First, the $A_{c3}$ point was determined for the steel plate of each of Test Numbers 1-1 to 1-30. Specifically, a test specimen for use in a Formaster test that is illustrated in FIG. 3 was prepared from the steel plate of each of Test Numbers 1-1 to 1-30. FIG. 3 is a side view of a test specimen used when determining the $A_{c3}$ point in the present example. The L direction in FIG. 3 corresponds to the plate thickness direction of the steel plate of each of Test Numbers 1-1 to 1-30. A thermocouple was welded at a point P of each test specimen of Test Numbers 1-1 to 1-30, and heating was performed at a heating rate of 20° C./min from room temperature to 1250° C. During heating, the length in the L direction of the test specimen of each test number was measured, and the relation between the coefficient of thermal expansion and the temperature was plotted. The temperature region of single-phase austenite was identified from the obtained plot. In the identified temperature region of single-phase austenite, the lowest temperature was defined as the $A_{c3}$ point.

Next, the respective steel plates of Test Numbers 1-1 to 1-30 were heated so as to become the respective quenching temperatures (° C.) described in Table 2. Note that, the respective quenching temperatures of Test Numbers 1-1 to 1-30 were set to the $A_{c3}$ point or more for the steel plates of the respective test numbers obtained by the aforementioned method. The steel plates of Test Numbers 1-1 to 1-30 were held for 20 minutes at the quenching temperature, and thereafter were subjected to water cooling using a shower-type water cooling apparatus. Note that, a type K thermocouple of a sheath type was inserted into a center portion of the thickness of the steel plate in advance, and the quenching temperature and cooling rate during quenching were measured using the type K thermocouple.

After the second quenching, the steel plates of Test Numbers 1-1 to 1-30 were subjected to tempering. A first tempering and a second tempering were performed for the steel plates of Test Numbers 1-1 to 1-14 and 1-16 to 1-30. On the other hand, tempering was performed only once for the steel plate of Test Number 1-15. The tempering temperature (° C.) and tempering time (min) for each of the first tempering and second tempering are shown in Table 2. Note that, the temperature of the furnace when tempering was performed was taken as the tempering temperature. The tempering time was taken as the time from when the temperature of the steel plate of the respective test numbers reached a predetermined tempering temperature until the steel plate was extracted from the furnace.

[Evaluation Tests]

The steel plates of Test Numbers 1-1 to 1-30 after the aforementioned tempering were subjected to a tensile test, a dislocation density measurement test, a prior-γ grain diameter measurement test, and an SSC resistance evaluation test that are described hereunder.

[Tensile Test]

The steel plates of Test Numbers 1-1 to 1-30 were subjected to a tensile test. The tensile test was performed in conformity with ASTM E8/E8M (2013). Round bar test

TABLE 2

| | Actually | | First Tempering | | Second Tempering | | | Prior-γ | | | SSC Resistance | |
|---|---|---|---|---|---|---|---|---|---|---|---|---|
| Test Number | Measured Ac3 Point (° C.) | Quenching Temperature (° C.) | Tempering Temperature (° C.) | Tempering Time (min) | Tempering Temperature (° C.) | Tempering Time (min) | σys (MPa) | Grain Diameter (μm) | Dislocation Density ρ ($10^{14}$ $m^{-2}$) | Fn2 | 1atm $H_2S$ 24° C. | 1atm $H_2S$ 4° C. |
| 1-1 | 936 | 950 | 350 | 30 | 690 | 30 | 849 | 20 | 1.7 | 706 | E | E |
| 1-2 | 959 | 980 | 350 | 30 | 690 | 50 | 857 | 29 | 2.1 | 697 | E | E |
| 1-3 | 959 | 980 | 350 | 30 | 690 | 50 | 859 | 28 | 2.2 | 696 | E | E |
| 1-4 | 965 | 980 | 350 | 30 | 710 | 50 | 839 | 29 | 1.1 | 724 | E | E |
| 1-5 | 940 | 960 | 350 | 30 | 700 | 50 | 840 | 29 | 1.1 | 725 | E | E |
| 1-6 | 927 | 940 | 350 | 30 | 695 | 50 | 860 | 17 | 1.4 | 730 | E | E |
| 1-7 | 933 | 950 | 400 | 30 | 695 | 50 | 831 | 23 | 1.5 | 696 | E | E |
| 1-8 | 963 | 980 | 300 | 40 | 710 | 50 | 821 | 27 | 0.5 | 743 | E | E |
| 1-9 | 947 | 960 | 300 | 70 | 700 | 50 | 831 | 21 | 1.1 | 716 | E | E |
| 1-10 | 960 | 980 | 250 | 90 | 695 | 80 | 833 | 29 | 1.2 | 713 | E | E |
| 1-11 | 881 | 900 | 300 | 50 | 695 | 50 | 861 | 13 | 2.3 | 694 | E | E |
| 1-12 | 904 | 920 | 300 | 40 | 695 | 50 | 844 | 21 | 1.8 | 696 | E | E |
| 1-13 | 959 | 980 | 300 | 40 | 695 | 50 | 858 | 27 | 1.4 | 728 | E | E |
| 1-14 | 978 | 990 | 300 | 40 | 710 | 50 | 848 | 30 | 1.7 | 705 | E | E |
| 1-15 | 960 | 980 | — | — | 705 | 50 | 856 | 29 | 4.7 | 618 | E | NA |
| 1-16 | 931 | 950 | 705 | 30 | 550 | 60 | 847 | 23 | 5.1 | 599 | E | NA |
| 1-17 | 860 | 900 | 350 | 30 | 695 | 50 | 852 | 16 | 2.8 | 668 | E | NA |
| 1-18 | 902 | 920 | 350 | 30 | 695 | 50 | 832 | 19 | 2.7 | 651 | E | NA |
| 1-19 | 950 | 970 | 350 | 30 | 700 | 50 | 855 | 26 | 1.6 | 716 | NA | NA |
| 1-20 | 901 | 920 | 350 | 30 | 695 | 50 | 793 | 22 | 1.8 | 645 | NA | NA |
| 1-21 | 845 | 900 | 350 | 30 | 700 | 50 | 834 | 11 | 1.6 | 695 | NA | NA |
| 1-22 | 958 | 980 | 350 | 30 | 700 | 50 | 856 | 29 | 2.1 | 697 | NA | NA |
| 1-23 | 945 | 960 | 350 | 30 | 695 | 50 | 842 | 22 | 1.7 | 699 | NA | NA |
| 1-24 | 915 | 940 | 350 | 30 | 685 | 50 | 853 | 26 | 3.1 | 659 | E | NA |
| 1-25 | 1012 | 1040 | 350 | 30 | 700 | 50 | 841 | 45 | 3.4 | 638 | NA | NA |
| 1-26 | 1061 | 1080 | 350 | 30 | 700 | 50 | 839 | 66 | 3.9 | 622 | NA | NA |
| 1-27 | 970 | 980 | 350 | 30 | 705 | 50 | 845 | 29 | 1.8 | 697 | E | NA |
| 1-28 | 929 | 950 | 350 | 30 | 705 | 50 | 852 | 24 | 1.9 | 700 | NA | NA |
| 1-29 | 950 | 970 | 350 | 30 | 705 | 50 | 858 | 26 | 2.0 | 702 | NA | NA |
| 1-30 | 947 | 965 | 350 | 30 | 705 | 50 | 853 | 24 | 1.9 | 701 | NA | NA |

With regard to the steel plates of Test Numbers 1-1 to 1-30 which were subjected to quenching, the steel plates were further subjected to a second quenching under the same conditions. Note that, in each of the first quenching and second quenching, the average cooling rate from 800° C. to 500° C. during quenching, that is, the cooling rate during quenching ($CR_{800-500}$) (° C./sec), was 10° C./sec.

specimens having a parallel portion diameter of 4 mm and a gauge length of 20 mm were prepared from the center portion of the thickness of the steel plates of Test Numbers 1-1 to 1-30. The axial direction of the round bar test specimens was parallel to the rolling direction of the steel plate. A tensile test was performed in the and the yield strength $\sigma_{YS}$ (MPa) of the steel plate of each of Test Numbers 1-1 to 1-30 was obtained. Note that, in the present example, 0.2% offset proof stress obtained in the tensile test was defined as the yield strength $\sigma_{YS}$. For Test Numbers 1-1 to 1-30, the obtained yield strength $\sigma_{YS}$ is shown as "$\sigma_{YS}$ (MPa)" in Table 2.

[Dislocation Density Measurement Test]

The steel plates of Test Numbers 1-1 to 1-30 were subjected to a dislocation density measurement test. Specifically, a test specimen for dislocation density measurement was prepared from the steel plate of each of Test Numbers 1-1 to 1-30 by the method described above. In addition, the dislocation density ρ ($m^{-2}$) was determined by the method described above using the test specimens of Test Numbers 1-1 to 1-30. For the steel plates of Test Numbers 1-1 to 1-30, the determined dislocation density ρ is shown as "dislocation density ρ ($10^{14}$ $m^{-2}$)" in Table 2. Furthermore, for the steel plates of Test Numbers 1-1 to 1-30, Fn2 that was determined based on the determined dislocation density ρ, the determined yield strength $\sigma_{YS}$, and the aforementioned definition is shown in Table 2.

[Prior-γ Grain Diameter Measurement Test]

The steel plates of Test Numbers 1-1 to 1-30 were subjected to a prior-γ grain diameter measurement test. Specifically, a test specimen for prior-γ grain diameter measurement was prepared from the steel plate of each of Test Numbers 1-1 to 1-30 by the method described above. In addition, the prior-γ grain diameter (μm) was determined by the method described above using the test specimens of Test Numbers 1-1 to 1-30. For the steel plates of Test Numbers 1-1 to 1-30, the determined prior-γ grain diameter is shown as "prior-γ grain diameter (μm)" in Table 2.

[SSC Resistance Evaluation Test]

The steel plates of Test Numbers 1-1 to 1-30 were subjected to an SSC resistance evaluation test. The SSC resistance was evaluated by a method performed in accordance with "Method A" specified in NACE TM0177-2005. Specifically, round bar test specimens having a diameter of 6.35 mm and a parallel portion length of 25.4 mm were prepared from the center portion of the thickness of the respective steel plates of Test Numbers 1-1 to 1-30. A room-temperature SSC resistance test was performed on three test specimens among the prepared test specimens. A low-temperature SSC resistance test was performed on another three test specimens among the prepared test specimens. Note that the axial direction of each test specimen was parallel to the rolling direction.

The room-temperature SSC resistance test was performed as follows. Tensile stress was applied in the axial direction of the round bar test specimens of Test Numbers 1-1 to 1-30. At this time, the applied stress was adjusted so as to be 95% of the actual yield stress of the respective steel plates. A mixed aqueous solution containing 5.0 mass % of sodium chloride and 0.5 mass % of acetic acid (NACE solution A) was used as the test solution. The test solution at 24° C. was poured into each of three test vessels, and these were adopted as test baths. Three round bar test specimens to which the stress was applied were immersed individually in mutually different test vessels as the test baths. After each test bath was degassed, $H_2S$ gas at 1 atm pressure was blown into the respective test baths and caused to saturate. The test baths in which the $H_2S$ gas at 1 atm pressure was saturated were held at 24° C. for 720 hours.

After being held for 720 hours, the round bar test specimens of Test Numbers 1-1 to 1-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not continued in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, similarly to the room-temperature SSC resistance test. In the low-temperature SSC resistance test, the applied stress was adjusted so as to be 90% of the actual yield stress of the respective steel plates. NACE solution A was used as the test solution, similarly to the room-temperature SSC resistance test. In addition, the temperature of the test bath was set to 4° C. The other conditions were made the same as in the room-temperature SSC resistance test.

After being immersed for 720 hours, the round bar test specimens of Test Numbers 1-1 to 1-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 2.

Referring to Table 1 and Table 2, the chemical composition of the respective steel plates of Test Numbers 1-1 to 1-14 was appropriate, and Fn1 was more than 85. In addition, Fn2 was more than 691. As a result, the steel plates of Test Numbers 1-1 to 1-14 exhibited excellent SSC resistance in the room-temperature SSC resistance test and the low-temperature SSC resistance test.

On the other hand, the steel plate of Test Number 1-15 was not subjected to low-temperature tempering. As a result, Fn2 was 691 or less. Consequently, the steel plate of Test Number 1-15 did not exhibit excellent SSC resistance in the low-temperature SSC resistance test.

The steel plate of Test Number 1-16 was subjected to low-temperature tempering after being subjected to high-temperature tempering. As a result, Fn2 was 691 or less. Consequently, the steel plate of Test Number 1-16 did not exhibit excellent SSC resistance in the low-temperature SSC resistance test.

In the steel plates of Test Numbers 1-17 and 1-18, the Si content was too low. As a result, Fn2 was 691 or less. Consequently, the steel plates of Test Numbers 1-17 and 1-18 did not exhibit excellent SSC resistance in the low-temperature SSC resistance test.

In the steel plate of Test Number 1-19, the Cr content was too low. Consequently, the steel plate of Test Number 1-19 did not exhibit excellent SSC resistance in either the room-temperature SSC resistance test or the low-temperature SSC resistance test.

In the steel plate of Test Number 1-20, the Mo content was too low. As a result, Fn2 was 691 or less. Consequently, the steel plate of Test Number 1-20 did not exhibit excellent SSC resistance in either the room-temperature SSC resistance test or the low-temperature SSC resistance test.

In the steel plate of Test Number 1-21, the Mn content was too high. Consequently, the steel plate of Test Number 1-21 did not exhibit excellent SSC resistance in either the room-temperature SSC resistance test or the low-temperature SSC resistance test.

In the steel plate of Test Number 1-22, the N content was too high. Consequently, the steel plate of Test Number 1-22 did not exhibit excellent SSC resistance in either the room-temperature SSC resistance test or the low-temperature SSC resistance test.

In the steel plate of Test Number 1-23, the P content was too high. Consequently, the steel plate of Test Number 1-23 did not exhibit excellent SSC resistance in either the room-temperature SSC resistance test or the low-temperature SSC resistance test.

In the steel plate of Test Number 1-24, the V content was too low. As a result, Fn2 was 691 or less. Consequently, the steel plate of Test Number 1-24 did not exhibit excellent SSC resistance in the low-temperature SSC resistance test.

In the steel plates of Test Numbers 1-25 and 1-26, Fn1 was 85 or less. As a result, Fn2 was 691 or less. Consequently, the steel plates of Test Numbers 1-25 and 1-26 did not exhibit excellent SSC resistance in either the room-temperature SSC resistance test or the low-temperature SSC resistance test.

In the steel plate of Test Number 1-27, the Mo content was too low. Consequently, the steel plate of Test Number 1-27 did not exhibit excellent SSC resistance in the low-temperature SSC resistance test.

In the steel plate of Test Number 1-28, the Mn content was too high. Consequently, the steel plate of Test Number 1-28 did not exhibit excellent SSC resistance in either the room-temperature SSC resistance test or the low-temperature SSC resistance test.

In the steel plate of Test Number 1-29, the Ti content was too high. Consequently, the steel plate of Test Number 1-29 did not exhibit excellent SSC resistance in either the room-temperature SSC resistance test or the low-temperature SSC resistance test.

In the steel plate of Test Number 1-30, the Nb content was too high. Consequently, the steel plate of Test Number 1-30 did not exhibit excellent SSC resistance in either the room-temperature SSC resistance test or the low-temperature SSC resistance test.

Example 2

In Example 2, steel material having a yield strength of 125 ksi grade (862 to less than 965 MPa) was investigated. Specifically, molten steels of a weight of 180 kg having the chemical compositions shown in Table 3 were produced. Note that, "-" in Table 3 means that the content of the corresponding element was at the level of an impurity. Further, Fn1 that was determined based on the chemical composition described in Table 3 and the aforementioned definition is shown in Table 3.

TABLE 3

| Test | Chemical composition (in mass %, balance being Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 2-1 | 0.31 | 1.88 | 0.47 | 0.011 | 0.0006 | 0.040 | 0.76 | 0.77 | 0.35 | 0.013 | 0.0013 | 0.0042 |
| 2-2 | 0.28 | 1.78 | 0.12 | 0.010 | 0.0007 | 0.038 | 0.99 | 0.69 | 0.42 | 0.013 | 0.0011 | 0.0038 |
| 2-3 | 0.29 | 1.65 | 0.35 | 0.006 | 0.0010 | 0.025 | 1.04 | 0.98 | 0.38 | 0.010 | 0.0015 | 0.0033 |
| 2-4 | 0.26 | 1.55 | 0.19 | 0.010 | 0.0007 | 0.026 | 0.66 | 0.88 | 0.20 | 0.014 | 0.0013 | 0.0024 |
| 2-5 | 0.32 | 1.60 | 0.26 | 0.012 | 0.0008 | 0.029 | 0.88 | 0.79 | 0.14 | 0.010 | 0.0013 | 0.0027 |
| 2-6 | 0.30 | 2.50 | 0.23 | 0.010 | 0.0010 | 0.035 | 0.97 | 0.90 | 0.08 | 0.012 | 0.0014 | 0.0040 |
| 2-7 | 0.26 | 1.75 | 0.43 | 0.010 | 0.0007 | 0.025 | 0.77 | 0.70 | 0.29 | 0.015 | 0.0012 | 0.0039 |
| 2-8 | 0.31 | 1.65 | 0.17 | 0.006 | 0.0007 | 0.042 | 0.78 | 0.63 | 0.09 | 0.009 | 0.0013 | 0.0032 |
| 2-9 | 0.27 | 1.43 | 0.24 | 0.010 | 0.0008 | 0.040 | 0.88 | 0.68 | 0.30 | 0.009 | 0.0012 | 0.0042 |
| 2-10 | 0.32 | 1.43 | 0.46 | 0.010 | 0.0010 | 0.044 | 0.96 | 0.70 | 0.34 | 0.015 | 0.0014 | 0.0038 |
| 2-11 | 0.29 | 2.49 | 0.21 | 0.010 | 0.0010 | 0.037 | 0.94 | 0.73 | 0.15 | 0.009 | 0.0013 | 0.0040 |
| 2-12 | 0.35 | 2.71 | 0.20 | 0.006 | 0.0009 | 0.030 | 0.75 | 0.74 | 0.14 | 0.015 | 0.0015 | 0.0036 |
| 2-13 | 0.36 | 1.82 | 0.30 | 0.007 | 0.0008 | 0.031 | 0.93 | 0.81 | 0.20 | 0.013 | 0.0013 | 0.0023 |
| 2-14 | 0.29 | 2.69 | 0.44 | 0.009 | 0.0006 | 0.038 | 0.97 | 0.90 | 0.14 | 0.009 | 0.0015 | 0.0026 |
| 2-15 | 0.28 | 2.19 | 0.32 | 0.008 | 0.0009 | 0.036 | 0.98 | 0.72 | 0.13 | 0.009 | 0.0013 | 0.0024 |
| 2-16 | 0.27 | 2.02 | 0.30 | 0.012 | 0.0007 | 0.027 | 1.03 | 0.94 | 0.26 | 0.009 | 0.0012 | 0.0029 |
| 2-17 | 0.30 | 0.84 | 0.47 | 0.009 | 0.0007 | 0.028 | 0.86 | 0.82 | 0.39 | 0.015 | 0.0014 | 0.0045 |
| 2-18 | 0.28 | 1.86 | 0.55 | 0.007 | 0.0008 | 0.039 | 0.02 | 0.73 | 0.48 | 0.014 | 0.0013 | 0.0039 |
| 2-19 | 0.29 | 2.23 | 0.37 | 0.008 | 0.0010 | 0.026 | 0.82 | 0.02 | 0.37 | 0.013 | 0.0014 | 0.0039 |
| 2-20 | 0.32 | 2.06 | 1.83 | 0.011 | 0.0009 | 0.036 | 1.04 | 0.68 | 0.34 | 0.014 | 0.0013 | 0.0038 |
| 2-21 | 0.31 | 1.75 | 0.17 | 0.007 | 0.0009 | 0.028 | 0.70 | 0.79 | 0.13 | 0.010 | 0.0011 | 0.0284 |
| 2-22 | 0.26 | 1.94 | 0.17 | 0.054 | 0.0007 | 0.035 | 0.91 | 0.71 | 0.31 | 0.010 | 0.0012 | 0.0022 |
| 2-23 | 0.26 | 1.27 | 0.41 | 0.011 | 0.0009 | 0.052 | 0.79 | 1.04 | 0.15 | 0.014 | 0.0012 | 0.0040 |
| 2-24 | 0.25 | 2.66 | 0.21 | 0.007 | 0.0008 | 0.039 | 0.73 | 0.82 | 0.09 | 0.012 | 0.0013 | 0.0042 |
| 2-25 | 0.26 | 2.72 | 0.26 | 0.009 | 0.0008 | 0.053 | 0.75 | 0.65 | 0.11 | 0.014 | 0.0015 | 0.0048 |
| 2-26 | 0.34 | 2.29 | 0.43 | 0.006 | 0.0006 | 0.030 | 0.66 | 0.67 | — | 0.009 | 0.0013 | 0.0034 |
| 2-27 | 0.29 | 2.34 | 0.36 | 0.008 | 0.0007 | 0.052 | 0.54 | 0.27 | 0.13 | 0.014 | 0.0010 | 0.0047 |
| 2-28 | 0.26 | 2.47 | 1.18 | 0.009 | 0.0007 | 0.047 | 0.81 | 0.87 | 0.09 | 0.012 | 0.0015 | 0.0031 |
| 2-29 | 0.30 | 2.38 | 0.47 | 0.007 | 0.0006 | 0.028 | 0.64 | 0.85 | 0.25 | 0.083 | 0.0013 | 0.0026 |
| 2-30 | 0.26 | 2.05 | 0.48 | 0.007 | 0.0010 | 0.049 | 0.82 | 0.64 | 0.23 | 0.011 | 0.0014 | 0.0045 |

| Test | Chemical composition (in mass %, balance being Fe and impurities) | | | | | | | | | | |
|---|---|---|---|---|---|---|---|---|---|---|---|
| Number | O | Nb | Ca | Mg | Zr | Nd | Co | W | Ni | Cu | Fn1 |
| 2-1 | 0.0006 | — | — | — | — | — | — | — | — | — | 139 |
| 2-2 | 0.0011 | 0.009 | — | — | — | — | — | — | — | — | 127 |
| 2-3 | 0.0008 | — | — | — | — | — | — | — | — | — | 137 |
| 2-4 | 0.0010 | 0.012 | — | — | — | — | — | — | — | — | 124 |
| 2-5 | 0.0007 | — | 0.0018 | — | — | — | — | — | — | — | 146 |
| 2-6 | 0.0016 | — | — | 0.0016 | — | — | — | — | — | — | 102 |

TABLE 3-continued

| | | | | | | | | | | | |
|---|---|---|---|---|---|---|---|---|---|---|---|
| 2-7 | 0.0009 | — | — | — | 0.0013 | — | — | — | — | — | 128 |
| 2-8 | 0.0007 | — | — | — | — | 0.0017 | — | — | — | — | 141 |
| 2-9 | 0.0012 | — | — | — | — | — | 0.29 | — | — | — | 137 |
| 2-10 | 0.0009 | — | — | — | — | — | — | 0.32 | — | — | 159 |
| 2-11 | 0.0007 | — | — | — | — | — | — | — | 0.05 | — | 101 |
| 2-12 | 0.0016 | — | — | — | — | — | — | — | — | 0.22 | 104 |
| 2-13 | 0.0007 | — | — | — | — | — | — | — | — | — | 150 |
| 2-14 | 0.0013 | — | — | — | — | — | — | — | — | — | 95 |
| 2-15 | 0.0007 | — | — | — | — | — | — | — | — | — | 116 |
| 2-16 | 0.0012 | — | — | — | — | — | — | — | — | — | 116 |
| 2-17 | 0.0012 | — | — | — | — | — | — | — | — | — | 163 |
| 2-18 | 0.0013 | — | — | — | — | — | — | — | — | — | 127 |
| 2-19 | 0.0019 | — | — | — | — | — | — | — | — | — | 127 |
| 2-20 | 0.0013 | — | — | — | — | — | — | — | — | — | 175 |
| 2-21 | 0.0013 | — | — | — | — | — | — | — | — | — | 135 |
| 2-22 | 0.0013 | — | — | — | — | — | — | — | — | — | 115 |
| 2-23 | 0.0013 | — | — | — | — | — | — | — | — | — | 137 |
| 2-24 | 0.0010 | — | — | — | — | — | — | — | — | — | 75 |
| 2-25 | 0.0011 | — | — | — | — | — | — | — | — | — | 80 |
| 2-26 | 0.0008 | — | — | — | — | — | — | — | — | — | 129 |
| 2-27 | 0.0015 | — | — | — | — | — | — | — | — | — | 116 |
| 2-28 | 0.0007 | — | — | — | — | — | — | — | — | — | 115 |
| 2-29 | 0.0015 | — | — | — | — | — | — | — | — | — | 112 |
| 2-30 | 0.0015 | 0.046 | — | — | — | — | — | — | — | — | 119 |

Ingots were produced using the molten steels described above. The ingots were hot rolled to produce steel plates having a plate thickness of 15 mm. After hot rolling, the steel plate of each of Test Numbers 2-1 to 2-30 whose steel plate temperature was made room temperature was subjected to quenching twice. First, the $A_{c3}$ point was determined for the steel plate of each of Test Numbers 2-1 to 2-30 by the same method as in Example 1. That is, similarly to Example 1, the lowest temperature in the temperature region of single-phase austenite that was identified based on the relation between the coefficient of thermal expansion of the test specimen and the temperature was defined as the $A_{c3}$ point.

Next, the respective steel plates of Test Numbers 2-1 to 2-30 were heated so as to become the respective quenching temperatures (° C.) described in Table 4. Note that, the respective quenching temperatures of Test Numbers 2-1 to 2-30 were set to the $A_{c3}$ point or more for the steel plates of the respective test numbers obtained by the aforementioned method. The steel plates of Test Numbers 2-1 to 2-30 were held for 20 minutes at the quenching temperature, and thereafter were subjected to water cooling using a shower-type water cooling apparatus. Note that, a type K thermocouple of a sheath type was inserted into a center portion of the thickness of the steel plate in advance, and the quenching temperature and cooling rate during quenching were measured using the type K thermocouple.

TABLE 4

| | Actually | | First Tempering | | Second Tempering | | | Prior-γ | | | SSC Resistance | |
|---|---|---|---|---|---|---|---|---|---|---|---|---|
| Test Number | Measured Ac3 Point (° C.) | Quenching Temperature (° C.) | Tempering Temperature (° C.) | Tempering Time (min) | Tempering Temperature (° C.) | Tempering Time (min) | σys (MPa) | Grain Diameter (μm) | Dislocation Density ρ ($10^{14}$ $m^{-2}$) | Fn2 | 1atm $H_2S$ 24° C. | 1atm $H_2S$ 4° C. |
| 2-1 | 936 | 960 | 350 | 30 | 680 | 30 | 948 | 24 | 4.8 | 707 | E | E |
| 2-2 | 968 | 980 | 350 | 30 | 680 | 50 | 935 | 30 | 4.3 | 707 | E | E |
| 2-3 | 940 | 960 | 350 | 30 | 680 | 50 | 930 | 27 | 4.5 | 697 | E | E |
| 2-4 | 941 | 960 | 350 | 30 | 680 | 50 | 915 | 26 | 3.3 | 715 | E | E |
| 2-5 | 898 | 920 | 350 | 30 | 680 | 50 | 953 | 17 | 4.5 | 720 | E | E |
| 2-6 | 966 | 980 | 350 | 30 | 685 | 50 | 940 | 30 | 3.5 | 734 | E | E |
| 2-7 | 944 | 970 | 400 | 30 | 680 | 50 | 920 | 25 | 3.4 | 717 | E | E |
| 2-8 | 904 | 930 | 300 | 40 | 680 | 50 | 945 | 20 | 4.4 | 714 | E | E |
| 2-9 | 922 | 950 | 300 | 70 | 680 | 50 | 925 | 23 | 3.2 | 728 | E | E |
| 2-10 | 897 | 920 | 250 | 90 | 680 | 80 | 940 | 20 | 3.7 | 728 | E | E |
| 2-11 | 977 | 990 | 300 | 50 | 680 | 50 | 955 | 29 | 2.8 | 771 | E | E |
| 2-12 | 964 | 980 | 300 | 40 | 690 | 50 | 942 | 29 | 2.5 | 768 | E | E |
| 2-13 | 894 | 920 | 300 | 40 | 695 | 50 | 895 | 19 | 2.1 | 736 | E | E |
| 2-14 | 979 | 990 | 300 | 40 | 690 | 50 | 925 | 30 | 4.0 | 705 | E | E |
| 2-15 | 944 | 970 | — | — | 680 | 50 | 943 | 29 | 8.9 | 615 | E | NA |
| 2-16 | 965 | 980 | 680 | 30 | 550 | 60 | 938 | 28 | 8.4 | 619 | E | NA |
| 2-17 | 883 | 920 | 350 | 30 | 680 | 50 | 921 | 17 | 6.7 | 636 | E | NA |
| 2-18 | 977 | 990 | 350 | 30 | 680 | 50 | 927 | 29 | 4.5 | 694 | NA | NA |
| 2-19 | 955 | 970 | 350 | 30 | 680 | 50 | 909 | 29 | 4.4 | 678 | NA | NA |
| 2-20 | 870 | 920 | 350 | 30 | 680 | 50 | 964 | 17 | 4.6 | 728 | NA | NA |
| 2-21 | 916 | 940 | 350 | 30 | 680 | 50 | 946 | 20 | 4.5 | 713 | NA | NA |
| 2-22 | 974 | 990 | 350 | 30 | 680 | 50 | 929 | 30 | 4.2 | 704 | NA | NA |
| 2-23 | 906 | 930 | 350 | 30 | 680 | 50 | 917 | 17 | 6.3 | 641 | E | NA |
| 2-24 | 1030 | 1070 | 350 | 30 | 680 | 50 | 929 | 60 | 7.1 | 636 | NA | NA |
| 2-25 | 1024 | 1050 | 350 | 30 | 680 | 50 | 945 | 53 | 7.9 | 636 | NA | NA |
| 2-26 | 904 | 930 | 350 | 30 | 680 | 50 | 910 | 25 | 6.5 | 630 | E | NA |
| 2-27 | 947 | 970 | 350 | 30 | 680 | 50 | 962 | 27 | 4.9 | 719 | E | NA |

TABLE 4-continued

| | Actually | | First Tempering | | Second Tempering | | | Prior-γ | | | SSC Resistance | |
|---|---|---|---|---|---|---|---|---|---|---|---|---|
| Test Number | Measured Ac3 Point (° C.) | Quenching Temperature (° C.) | Tempering Temperature (° C.) | Tempering Time (min) | Tempering Temperature (° C.) | Tempering Time (min) | σys (MPa) | Grain Diameter (μm) | Dislocation Density ρ ($10^{14}$ $m^{-2}$) | Fn2 | 1atm $H_2S$ 24° C. | 1atm $H_2S$ 4° C. |
| 2-28 | 930 | 950 | 350 | 30 | 680 | 50 | 952 | 21 | 4.6 | 716 | NA | NA |
| 2-29 | 975 | 990 | 350 | 30 | 680 | 50 | 962 | 30 | 4.9 | 719 | NA | NA |
| 2-30 | 955 | 970 | 350 | 30 | 680 | 50 | 941 | 28 | 3.7 | 729 | NA | NA |

With regard to the steel plates of Test Numbers 2-1 to 2-30 which were subjected to quenching, the steel plates were further subjected to a second quenching under the same conditions. Note that, in each of the first quenching and second quenching, the average cooling rate from 800° C. to 500° C. during quenching, that is, the cooling rate during quenching ($CR_{800-500}$) (° C./sec), was 10° C./sec.

After the second quenching, the steel plates of Test Numbers 2-1 to 2-30 were subjected to tempering. A first tempering and a second tempering were performed for the steel plates of Test Numbers 2-1 to 2-14 and 2-16 to 2-30. On the other hand, tempering was performed only once for the steel plate of Test Number 2-15. The tempering temperature (° C.) and tempering time (min) for each of the first tempering and second tempering are shown in Table 4. Note that, the temperature of the furnace when tempering was performed was taken as the tempering temperature. The tempering time was taken as the time from when the temperature of the steel plate of the respective test numbers reached a predetermined tempering temperature until the steel plate was extracted from the furnace.

[Evaluation Tests]

The steel plates of Test Numbers 2-1 to 2-30 after the aforementioned tempering were subjected to a tensile test, a dislocation density measurement test, a prior-γ grain diameter measurement test, and an SSC resistance evaluation test that are described hereunder.

[Tensile Test]

The steel plates of Test Numbers 2-1 to 2-30 were subjected to a tensile test by the same method as in Example 1. Specifically, round bar test specimens having a parallel portion diameter of 4 mm and a gauge length of 20 mm in which the axial direction was parallel to the rolling direction of the steel plate were prepared from the center portion of the thickness of the steel plates of Test Numbers 2-1 to 2-30. A tensile test was performed in conformity with ASTM E8/E8M (2013) in the atmosphere at room temperature (25° C.) using the prepared round bar test specimens, and the yield strength $\sigma_{YS}$ (MPa) of the steel plate of each of Test Numbers 2-1 to 2-30 was obtained. Note that, in the present example, 0.2% offset proof stress obtained in the tensile test was defined as the yield strength $\sigma_{YS}$. For Test Numbers 2-1 to 2-30, the obtained yield strength $\sigma_{YS}$ is shown as "$\sigma_{YS}$ (MPa)" in Table 4.

[Dislocation Density Measurement Test]

The steel plates of Test Numbers 2-1 to 2-30 were subjected to a dislocation density measurement test. Specifically, a test specimen for dislocation density measurement was prepared from the steel plate of each of Test Numbers 2-1 to 2-30 by the method described above. In addition, the dislocation density ρ ($m^{-2}$) was determined by the method described above using the test specimens of Test Numbers 2-1 to 2-30. For the steel plates of Test Numbers 2-1 to 2-30, the determined dislocation density ρ is shown as "dislocation density ρ ($10^{14}$ $m^{-2}$)" in Table 4. Furthermore, for the steel plates of Test Numbers 2-1 to 2-30, Fn2 that was determined based on the determined dislocation density ρ, the determined yield strength $\sigma_{YS}$, and the aforementioned definition is shown in Table 4.

[Prior-γ Grain Diameter Measurement Test]

The steel plates of Test Numbers 2-1 to 2-30 were subjected to a prior-γ grain diameter measurement test. Specifically, a test specimen for prior-γ grain diameter measurement was prepared from the steel plates of Test Numbers 2-1 to 2-30 by the method described above. In addition, the prior-γ grain diameter (μm) was determined by the method described above using the test specimens of Test Numbers 2-1 to 2-30. For the steel plates of Test Numbers 2-1 to 2-30, the determined prior-γ grain diameter is shown as "prior-γ grain diameter (μm)" in Table 4.

[SSC Resistance Evaluation Test]

The steel plates of Test Numbers 2-1 to 2-30 were subjected to an SSC resistance evaluation test. The SSC resistance was evaluated by a method performed in accordance with "Method A" specified in NACE TM0177-2005. Specifically, round bar test specimens having a diameter of 6.35 mm and a parallel portion length of 25.4 mm were prepared from the center portion of the thickness of the respective steel plates of Test Numbers 2-1 to 2-30. A room-temperature SSC resistance test was performed on three test specimens among the prepared test specimens. A low-temperature SSC resistance test was performed on another three test specimens among the prepared test specimens. Note that the axial direction of each test specimen was parallel to the rolling direction.

The room-temperature SSC resistance test was performed as follows. Tensile stress was applied in the axial direction of the round bar test specimens of Test Numbers 2-1 to 2-30. At this time, the applied stress was adjusted so as to be 95% of the actual yield stress of the respective steel plates. A mixed aqueous solution containing 5.0 mass % of sodium chloride and 0.5 mass % of acetic acid (NACE solution A) was used as the test solution. The test solution at 24° C. was poured into each of three test vessels, and these were adopted as test baths. Three round bar test specimens to which the stress was applied were immersed individually in mutually different test vessels as the test baths. After each test bath was degassed, $H_2S$ gas at 1 atm pressure was blown into the respective test baths and caused to saturate. The test baths in which the $H_2S$ gas at 1 atm pressure was saturated were held at 24° C. for 720 hours.

After being held for 720 hours, the round bar test specimens of Test Numbers 2-1 to 2-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not continued in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, similarly to the room-temperature SSC resistance test. In the low-temperature SSC resistance test, the applied stress was adjusted so as to be 85% of the actual yield stress of the respective steel plates. NACE solution A was used as the test solution, similarly to the room-temperature SSC resistance test. In addition, the temperature of the test bath was set to 4° C. The other conditions were made the same as in the room-temperature SSC resistance test.

After being immersed for 720 hours, the round bar test specimens of Test Numbers 2-1 to 2-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 4.

Referring to Table 3 and Table 4, the chemical composition of the respective steel plates of Test Numbers 2-1 to 2-14 was appropriate, and Fn1 was more than 85. In addition, Fn2 was more than 691. As a result, the steel plates of Test Numbers 2-1 to 2-14 exhibited excellent SSC resistance in the room-temperature SSC resistance test and the low-temperature SSC resistance test.

On the other hand, the steel plate of Test Number 2-15 was not subjected to low-temperature tempering. As a result, Fn2 was 691 or less. Consequently, the steel plate of Test Number 2-15 did not exhibit excellent SSC resistance in the low-temperature SSC resistance test.

The steel plate of Test Number 2-16 was subjected to low-temperature tempering after being subjected to high-temperature tempering. As a result, Fn2 was 691 or less. Consequently, the steel plate of Test Number 2-16 did not exhibit excellent SSC resistance in the low-temperature SSC resistance test.

In the steel plate of Test Number 2-17, the Si content was too low. As a result, Fn2 was 691 or less. Consequently, the steel plate of Test Number 2-17 did not exhibit excellent SSC resistance in the low-temperature SSC resistance test.

In the steel plate of Test Number 2-18, the Cr content was too low. Consequently, the steel plate of Test Number 2-18 did not exhibit excellent SSC resistance in either the room-temperature SSC resistance test or the low-temperature SSC resistance test.

In the steel plate of Test Number 2-19, the Mo content was too low. As a result, Fn2 was 691 or less. Consequently, the steel plate of Test Number 2-19 did not exhibit excellent SSC resistance in either the room-temperature SSC resistance test or the low-temperature SSC resistance test.

In the steel plate of Test Number 2-20, the Mn content was too high. Consequently, the steel plate of Test Number 2-20 did not exhibit excellent SSC resistance in either the room-temperature SSC resistance test or the low-temperature SSC resistance test.

In the steel plate of Test Number 2-21, the N content was too high. Consequently, the steel plate of Test Number 2-21 did not exhibit excellent SSC resistance in either the room-temperature SSC resistance test or the low-temperature SSC resistance test.

In the steel plate of Test Number 2-22, the P content was too high. Consequently, the steel plate of Test Number 2-22 did not exhibit excellent SSC resistance in either the room-temperature SSC resistance test or the low-temperature SSC resistance test. In the steel plate of Test Number 2-23, the Si content was too low. As a result, Fn2 was 691 or less. Consequently, the steel plate of Test Number 2-23 did not exhibit excellent SSC resistance in the low-temperature SSC resistance test.

In the steel plates of Test Numbers 2-24 and 2-25, Fn1 was 85 or less. As a result, Fn2 was 691 or less. Consequently, the steel plates of Test Numbers 2-24 and 2-25 did not exhibit excellent SSC resistance in either the room-temperature SSC resistance test or the low-temperature SSC resistance test.

In the steel plate of Test Number 2-26, the V content was too low. As a result, Fn2 was 691 or less. Consequently, the steel plate of Test Number 2-26 did not exhibit excellent SSC resistance in the low-temperature SSC resistance test.

In the steel plate of Test Number 2-27, the Mo content was too low. Consequently, the steel plate of Test Number 2-27 did not exhibit excellent SSC resistance in the low-temperature SSC resistance test.

In the steel plate of Test Number 2-28, the Mn content was too high. Consequently, the steel plate of Test Number 2-28 did not exhibit excellent SSC resistance in either the room-temperature SSC resistance test or the low-temperature SSC resistance test.

In the steel plate of Test Number 2-29, the Ti content was too high. Consequently, the steel plate of Test Number 2-29 did not exhibit excellent SSC resistance in either the room-temperature SSC resistance test or the low-temperature SSC resistance test.

In the steel plate of Test Number 2-30, the Nb content was too high. Consequently, the steel plate of Test Number 2-30 did not exhibit excellent SSC resistance in either the room-temperature SSC resistance test or the low-temperature SSC resistance test.

Example 3

In Example 3, steel material having a yield strength of 140 ksi or more (965 MPa or more) was investigated. Specifically, molten steels of a weight of 180 kg having the chemical compositions shown in Table 5 were produced. Note that, "-" in Table 5 means that the content of the corresponding element was at the level of an impurity. Further, Fn1 that was determined based on the chemical composition described in Table 5 and the aforementioned definition is shown in Table 5.

TABLE 5

| Test | Chemical composition (in mass %, balance being Fe and impurities) | | | | | | | | | | | |
|---|---|---|---|---|---|---|---|---|---|---|---|---|
| Number | C | Si | Mn | P | S | Al | Cr | Mo | V | Ti | B | N |
| 3-1 | 0.34 | 2.47 | 0.40 | 0.008 | 0.0010 | 0.029 | 0.67 | 0.91 | 0.31 | 0.012 | 0.0011 | 0.0039 |
| 3-2 | 0.34 | 2.25 | 0.39 | 0.007 | 0.0010 | 0.036 | 0.77 | 0.67 | 0.19 | 0.011 | 0.0012 | 0.0031 |
| 3-3 | 0.33 | 2.09 | 0.39 | 0.011 | 0.0007 | 0.047 | 0.74 | 0.82 | 0.41 | 0.009 | 0.0014 | 0.0030 |

TABLE 5-continued

| | | | | | | | | | | | | |
|---|---|---|---|---|---|---|---|---|---|---|---|---|
| 3-4 | 0.34 | 1.55 | 0.46 | 0.007 | 0.0006 | 0.035 | 0.86 | 0.85 | 0.39 | 0.013 | 0.0015 | 0.0046 |
| 3-5 | 0.27 | 1.86 | 0.12 | 0.008 | 0.0010 | 0.042 | 1.04 | 0.83 | 0.15 | 0.011 | 0.0012 | 0.0044 |
| 3-6 | 0.29 | 2.00 | 0.23 | 0.011 | 0.0009 | 0.043 | 0.86 | 0.96 | 0.13 | 0.012 | 0.0015 | 0.0036 |
| 3-7 | 0.37 | 2.35 | 0.18 | 0.010 | 0.0008 | 0.042 | 1.00 | 0.67 | 0.44 | 0.014 | 0.0013 | 0.0023 |
| 3-8 | 0.28 | 1.74 | 0.14 | 0.009 | 0.0007 | 0.027 | 0.69 | 0.97 | 0.09 | 0.010 | 0.0011 | 0.0042 |
| 3-9 | 0.26 | 1.90 | 0.41 | 0.007 | 0.0009 | 0.050 | 0.90 | 0.97 | 0.27 | 0.009 | 0.0013 | 0.0024 |
| 3-10 | 0.30 | 2.41 | 0.42 | 0.009 | 0.0008 | 0.043 | 0.77 | 0.87 | 0.20 | 0.014 | 0.0012 | 0.0046 |
| 3-11 | 0.37 | 1.46 | 0.24 | 0.010 | 0.0009 | 0.037 | 0.68 | 0.95 | 0.45 | 0.010 | 0.0012 | 0.0036 |
| 3-12 | 0.34 | 2.74 | 0.34 | 0.010 | 0.0007 | 0.037 | 1.05 | 0.91 | 0.20 | 0.014 | 0.0011 | 0.0025 |
| 3-13 | 0.33 | 1.97 | 0.14 | 0.006 | 0.0009 | 0.047 | 1.01 | 0.67 | 0.41 | 0.010 | 0.0013 | 0.0038 |
| 3-14 | 0.30 | 2.59 | 0.22 | 0.009 | 0.0006 | 0.040 | 0.67 | 0.86 | 0.13 | 0.010 | 0.0013 | 0.0026 |
| 3-15 | 0.33 | 2.37 | 0.18 | 0.008 | 0.0009 | 0.028 | 0.90 | 0.83 | 0.35 | 0.010 | 0.0015 | 0.0045 |
| 3-16 | 0.27 | 2.03 | 0.32 | 0.007 | 0.0009 | 0.054 | 0.79 | 0.84 | 0.35 | 0.012 | 0.0015 | 0.0030 |
| 3-17 | 0.34 | 0.81 | 0.38 | 0.006 | 0.0006 | 0.045 | 0.97 | 0.86 | 0.47 | 0.015 | 0.0012 | 0.0026 |
| 3-18 | 0.31 | 1.96 | 0.47 | 0.010 | 0.0007 | 0.037 | 0.06 | 0.65 | 0.47 | 0.014 | 0.0013 | 0.0031 |
| 3-19 | 0.26 | 2.25 | 0.43 | 0.009 | 0.0009 | 0.025 | 1.04 | 0.10 | 0.31 | 0.014 | 0.0013 | 0.0029 |
| 3-20 | 0.32 | 2.83 | 1.78 | 0.010 | 0.0009 | 0.043 | 0.86 | 0.72 | 0.39 | 0.012 | 0.0012 | 0.0032 |
| 3-21 | 0.36 | 1.42 | 0.30 | 0.012 | 0.0010 | 0.028 | 0.75 | 0.71 | 0.38 | 0.010 | 0.0013 | 0.0133 |
| 3-22 | 0.33 | 2.36 | 0.10 | 0.048 | 0.0009 | 0.041 | 0.89 | 0.65 | 0.31 | 0.012 | 0.0015 | 0.0040 |
| 3-23 | 0.25 | 1.12 | 0.44 | 0.010 | 0.0009 | 0.049 | 0.64 | 0.99 | 0.13 | 0.015 | 0.0011 | 0.0039 |
| 3-24 | 0.26 | 2.74 | 0.37 | 0.008 | 0.0010 | 0.038 | 0.77 | 0.81 | 0.15 | 0.013 | 0.0011 | 0.0041 |
| 3-25 | 0.26 | 2.64 | 0.23 | 0.011 | 0.0008 | 0.047 | 0.73 | 1.04 | 0.10 | 0.015 | 0.0011 | 0.0044 |
| 3-26 | 0.34 | 2.28 | 0.31 | 0.010 | 0.0008 | 0.029 | 0.66 | 1.11 | — | 0.010 | 0.0011 | 0.0037 |
| 3-27 | 0.28 | 2.37 | 0.48 | 0.007 | 0.0008 | 0.030 | 0.94 | 0.27 | 0.07 | 0.011 | 0.0010 | 0.0047 |
| 3-28 | 0.27 | 2.47 | 1.22 | 0.006 | 0.0008 | 0.054 | 0.65 | 0.80 | 0.09 | 0.015 | 0.0014 | 0.0044 |
| 3-29 | 0.26 | 1.87 | 0.45 | 0.010 | 0.0006 | 0.048 | 0.69 | 0.76 | 0.29 | 0.075 | 0.0010 | 0.0025 |
| 3-30 | 0.29 | 2.31 | 0.59 | 0.008 | 0.0006 | 0.047 | 0.47 | 0.95 | 0.31 | 0.015 | 0.0012 | 0.0027 |

| Test | Chemical composition (in mass %, balance being Fe and impurities) | | | | | | | | | | |
|---|---|---|---|---|---|---|---|---|---|---|---|
| Number | O | Nb | Ca | Mg | Zr | Nd | Co | W | Ni | Cu | Fn1 |
| 3-1 | 0.0015 | — | — | — | — | — | — | — | — | — | 116 |
| 3-2 | 0.0015 | 0.014 | — | — | — | — | — | — | — | — | 131 |
| 3-3 | 0.0015 | — | — | — | — | — | — | — | — | — | 133 |
| 3-4 | 0.0016 | 0.015 | — | — | — | — | — | — | — | — | 157 |
| 3-5 | 0.0010 | — | 0.0013 | — | — | — | — | — | — | — | 119 |
| 3-6 | 0.0009 | — | — | 0.0017 | — | — | — | — | — | — | 120 |
| 3-7 | 0.0012 | — | — | — | 0.0010 | — | — | — | — | — | 129 |
| 3-8 | 0.0009 | — | — | — | — | 0.0016 | — | — | — | — | 122 |
| 3-9 | 0.0016 | — | — | — | — | — | 0.15 | — | — | — | 119 |
| 3-10 | 0.0013 | — | — | — | — | — | — | 0.31 | — | — | 111 |
| 3-11 | 0.0006 | — | — | — | — | — | — | — | 0.07 | — | 157 |
| 3-12 | 0.0016 | — | — | — | — | — | — | — | — | 0.20 | 104 |
| 3-13 | 0.0016 | — | — | — | — | — | — | — | — | — | 136 |
| 3-14 | 0.0012 | — | — | — | — | — | — | — | — | — | 95 |
| 3-15 | 0.0013 | — | — | — | — | — | — | — | — | — | 116 |
| 3-16 | 0.0015 | — | — | — | — | — | — | — | — | — | 116 |
| 3-17 | 0.0019 | — | — | — | — | — | — | — | — | — | 172 |
| 3-18 | 0.0015 | — | — | — | — | — | — | — | — | — | 131 |
| 3-19 | 0.0008 | — | — | — | — | — | — | — | — | — | 118 |
| 3-20 | 0.0019 | — | — | — | — | — | — | — | — | — | 133 |
| 3-21 | 0.0013 | — | — | — | — | — | — | — | — | — | 162 |
| 3-22 | 0.0011 | — | — | — | — | — | — | — | — | — | 117 |
| 3-23 | 0.0016 | — | — | — | — | — | — | — | — | — | 136 |
| 3-24 | 0.0011 | — | — | — | — | — | — | — | — | — | 80 |
| 3-25 | 0.0014 | — | — | — | — | — | — | — | — | — | 78 |
| 3-26 | 0.0012 | — | — | — | — | — | — | — | — | — | 120 |
| 3-27 | 0.0008 | — | — | — | — | — | — | — | — | — | 118 |
| 3-28 | 0.0014 | — | — | — | — | — | — | — | — | — | 119 |
| 3-29 | 0.0012 | — | — | — | — | — | — | — | — | — | 122 |
| 3-30 | 0.0007 | 0.049 | — | — | — | — | — | — | — | — | 113 |

Ingots were produced using the molten steels described above. The ingots were hot rolled to produce steel plates having a plate thickness of 15 mm. After hot rolling, the steel plate of each of Test Numbers 3-1 to 3-30 whose steel plate temperature was made room temperature was subjected to quenching twice. First, the $A_{c3}$ point was determined for the steel plate of each of Test Numbers 3-1 to 3-30 by the same method as in Example 1. That is, similarly to Example 1, the lowest temperature in the temperature region of single-phase austenite that was identified based on the relation between the coefficient of thermal expansion of the test specimen and the temperature was defined as the $A_{c3}$ point.

Next, the respective steel plates of Test Numbers 3-1 to 3-30 were heated so as to become the respective quenching temperatures (° C.) described in Table 6. Note that, the respective quenching temperatures of Test Numbers 3-1 to 3-30 were set to the $A_{c3}$ point or more for the steel plates of the respective test numbers obtained by the aforementioned method. The steel plates of Test Numbers 3-1 to 3-30 were held for 20 minutes at the quenching temperature, and thereafter were subjected to water cooling using a shower-type water cooling apparatus. Note that, a type K thermocouple of a sheath type was inserted into a center portion of the thickness of the steel plate in advance, and the quenching temperature and cooling rate during quenching were measured using the type K thermocouple.

TABLE 6

| Test Number | Actually Measured Ac3 Point (° C.) | Actually Quenching Temperature (° C.) | First Tempering Temperature (° C.) | First Tempering Time (min) | Second Tempering Temperature (° C.) | Second Tempering Time (min) | σys (MPa) | Prior-γ Grain Diameter (μm) | Prior-γ Dislocation Density ρ ($10^{14}$ $m^{-2}$) | Fn2 | SSC Resistance 1atm $H_2S$ 24° C. | SSC Resistance 1atm $H_2S$ 4° C. |
|---|---|---|---|---|---|---|---|---|---|---|---|---|
| 3-1 | 966 | 980 | 350 | 30 | 670 | 40 | 1025 | 30 | 7.2 | 730 | E | E |
| 3-2 | 921 | 940 | 350 | 30 | 670 | 60 | 1017 | 20 | 7.0 | 726 | E | E |
| 3-3 | 950 | 970 | 350 | 30 | 670 | 60 | 1004 | 29 | 6.9 | 715 | E | E |
| 3-4 | 908 | 930 | 350 | 30 | 670 | 60 | 997 | 18 | 6.8 | 710 | E | E |
| 3-5 | 945 | 960 | 350 | 30 | 660 | 60 | 1036 | 26 | 8.9 | 708 | E | E |
| 3-6 | 944 | 960 | 350 | 30 | 665 | 60 | 1017 | 27 | 7.5 | 716 | E | E |
| 3-7 | 956 | 970 | 400 | 30 | 675 | 60 | 999 | 25 | 6.1 | 727 | E | E |
| 3-8 | 937 | 950 | 300 | 40 | 670 | 60 | 976 | 24 | 5.7 | 713 | E | E |
| 3-9 | 960 | 980 | 300 | 70 | 670 | 60 | 970 | 30 | 5.7 | 707 | E | E |
| 3-10 | 966 | 980 | 250 | 90 | 670 | 90 | 998 | 30 | 5.2 | 747 | E | E |
| 3-11 | 907 | 920 | 300 | 50 | 670 | 60 | 1015 | 19 | 7.6 | 712 | E | E |
| 3-12 | 961 | 980 | 300 | 40 | 670 | 60 | 1025 | 30 | 7.2 | 730 | E | E |
| 3-13 | 947 | 970 | 300 | 40 | 670 | 60 | 1008 | 29 | 6.6 | 725 | E | E |
| 3-14 | 980 | 990 | 300 | 40 | 680 | 50 | 967 | 30 | 5.5 | 709 | E | E |
| 3-15 | 976 | 990 | — | — | 670 | 60 | 1014 | 30 | 15.3 | 584 | E | NA |
| 3-16 | 980 | 990 | 670 | 30 | 550 | 70 | 975 | 30 | 13.2 | 575 | E | NA |
| 3-17 | 881 | 920 | 350 | 30 | 670 | 60 | 986 | 18 | 8.6 | 663 | E | NA |
| 3-18 | 968 | 980 | 350 | 30 | 670 | 60 | 983 | 30 | 6.4 | 705 | NA | NA |
| 3-19 | 966 | 980 | 350 | 30 | 650 | 60 | 973 | 27 | 6.9 | 684 | NA | NA |
| 3-20 | 925 | 940 | 350 | 30 | 670 | 60 | 1024 | 21 | 7.4 | 725 | NA | NA |
| 3-21 | 892 | 930 | 350 | 30 | 670 | 60 | 1008 | 21 | 7.1 | 715 | NA | NA |
| 3-22 | 970 | 980 | 350 | 30 | 670 | 60 | 1010 | 28 | 7.0 | 719 | NA | NA |
| 3-23 | 902 | 920 | 350 | 30 | 660 | 60 | 1008 | 19 | 9.1 | 676 | E | NA |
| 3-24 | 1027 | 1040 | 350 | 30 | 670 | 60 | 978 | 49 | 12.2 | 594 | NA | NA |
| 3-25 | 1019 | 1070 | 350 | 30 | 670 | 60 | 984 | 63 | 12.8 | 590 | NA | NA |
| 3-26 | 918 | 940 | 350 | 30 | 660 | 60 | 1026 | 26 | 13.0 | 629 | E | NA |
| 3-27 | 929 | 950 | 350 | 30 | 670 | 60 | 1020 | 24 | 6.9 | 731 | E | NA |
| 3-28 | 924 | 950 | 350 | 30 | 670 | 60 | 1015 | 23 | 7.0 | 724 | NA | NA |
| 3-29 | 963 | 980 | 350 | 30 | 670 | 60 | 998 | 30 | 6.9 | 709 | NA | NA |
| 3-30 | 978 | 990 | 350 | 30 | 670 | 60 | 1017 | 30 | 7.3 | 720 | NA | NA |

With regard to the steel plates of Test Numbers 3-1 to 3-30 which were subjected to quenching, the steel plates were further subjected to a second quenching under the same conditions. Note that, in each of the first quenching and second quenching, the average cooling rate from 800° C. to 500° C. during quenching, that is, the cooling rate during quenching ($CR_{800-500}$) (° C./sec), was 10° C./sec.

After the second quenching, the steel plates of Test Numbers 3-1 to 3-30 were subjected to tempering. A first tempering and a second tempering were performed for the steel plates of Test Numbers 3-1 to 3-14 and 3-16 to 3-30. On the other hand, tempering was performed only once for the steel plate of Test Number 3-15. The tempering temperature (° C.) and tempering time (min) for each of the first tempering and second tempering are shown in Table 6. Note that, the temperature of the furnace when tempering was performed was taken as the tempering temperature. The tempering time was taken as the time from when the temperature of the steel plate of each test number reached a predetermined tempering temperature until the steel plate was extracted from the furnace.

[Evaluation Tests]

The steel plates of Test Numbers 3-1 to 3-30 after the aforementioned tempering were subjected to a tensile test, a dislocation density measurement test, a prior-γ grain diameter measurement test, and an SSC resistance evaluation test that are described hereunder.

[Tensile Test]

The steel plates of Test Numbers 3-1 to 3-30 were subjected to a tensile test by the same method as in Example 1. Specifically, round bar test specimens having a parallel portion diameter of 4 mm and a gauge length of 20 mm in which the axial direction was parallel to the rolling direction of the steel plate were prepared from the center portion of the thickness of the steel plates of Test Numbers 3-1 to 3-30. A tensile test was performed in conformity with ASTM E8/E8M (2013) in the atmosphere at room temperature (25° C.) using the prepared round bar test specimens, and the yield strength $\sigma_{YS}$ (MPa) of the steel plate of each of Test Numbers 3-1 to 3-30 was obtained. Note that, in the present example, 0.2% offset proof stress obtained in the tensile test was defined as the yield strength $\sigma_{YS}$. For Test Numbers 3-1 to 3-30, the obtained yield strength $\sigma_{YS}$ is shown as "$\sigma_{YS}$ (MPa)" in Table 6.

[Dislocation Density Measurement Test]

The steel plates of Test Numbers 3-1 to 3-30 were subjected to a dislocation density measurement test. Specifically, a test specimen for dislocation density measurement was prepared from the steel plate of each of Test Numbers 3-1 to 3-30 by the method described above. In addition, the dislocation density ρ ($m^{-2}$) was determined by the method described above using the test specimens of Test Numbers 3-1 to 3-30. For the steel plates of Test Numbers 3-1 to 3-30, the determined dislocation density ρ is shown as "dislocation density ρ ($10^{14}$ $m^{-2}$)" in Table 6. Furthermore, for the steel plates of Test Numbers 3-1 to 3-30, Fn2 that was determined based on the determined dislocation density ρ, the determined yield strength $\sigma_{YS}$, and the aforementioned definition is shown in Table 6.

[Prior-γ Grain Diameter Measurement Test]

The steel plates of Test Numbers 3-1 to 3-30 were subjected to a prior-γ grain diameter measurement test. Specifically, a test specimen for prior-γ grain diameter measurement was prepared from the steel plates of Test Numbers 3-1 to 3-30 by the method described above. In addition, the prior-γ grain diameter (μm) was determined by the method described above using the test specimens of Test Numbers 3-1 to 3-30. For the steel plates of Test Numbers 3-1 to 3-30, the determined prior-γ grain diameter is shown as "prior-γ grain diameter (μm)" in Table 6.

[SSC Resistance Evaluation Test]

The steel plates of Test Numbers 3-1 to 3-30 were subjected to an SSC resistance evaluation test. The SSC resistance was evaluated by a method performed in accordance with "Method A" specified in NACE TM0177-2005. Specifically, round bar test specimens having a diameter of 6.35 mm and a parallel portion length of 25.4 mm were prepared from the center portion of the thickness of the respective steel plates of Test Numbers 3-1 to 3-30. A room-temperature SSC resistance test was performed on three test specimens among the prepared test specimens. A low-temperature SSC resistance test was performed on another three test specimens among the prepared test specimens. Note that the axial direction of each test specimen was parallel to the rolling direction.

The room-temperature SSC resistance test was performed as follows. Tensile stress was applied in the axial direction of the round bar test specimens of Test Numbers 3-1 to 3-30. At this time, the applied stress was adjusted so as to be 95% of the actual yield stress of the respective steel plates. A mixed aqueous solution containing 5.0 mass % of sodium chloride and 0.4 mass % of sodium acetate that is adjusted to pH 3.5 using acetic acid (NACE solution B) was used as the test solution. The test solution at 24° C. was poured into each of three test vessels, and these were adopted as test baths. Three round bar test specimens to which the stress was applied were immersed individually in mutually different test vessels as the test baths. After each test bath was degassed, a mixed gas of $H_2S$ gas at 0.1 atm pressure and $CO_2$ gas at 0.9 atm pressure was blown into the respective test baths and caused to saturate. The test baths into which the mixed gas of $H_2S$ gas at 0.1 atm pressure and $CO_2$ gas at 0.9 atm pressure was saturated were held at 24° C. for 720 hours.

After being held for 720 hours, the round bar test specimens of Test Numbers 3-1 to 3-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, similarly to the room-temperature SSC resistance test. In the low-temperature SSC resistance test, the applied stress was adjusted so as to be 85% (820 MPa) of 965 MPa. NACE solution B was used as the test solution, similarly to the room-temperature SSC resistance test. In addition, the temperature of the test bath was set to 4° C. The other conditions were made the same as in the room-temperature SSC resistance test.

After being immersed for 720 hours, the round bar test specimens of Test Numbers 3-1 to 3-30 were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 6.

Referring to Table 5 and Table 6, the chemical composition of the respective steel plates of Test Numbers 3-1 to 3-14 was appropriate, and Fn1 was more than 85. In addition, Fn2 was more than 691. As a result, the steel plates of Test Numbers 3-1 to 3-14 exhibited excellent SSC resistance in the room-temperature SSC resistance test and the low-temperature SSC resistance test.

On the other hand, the steel plate of Test Number 3-15 was not subjected to low-temperature tempering. As a result, Fn2 was 691 or less. Consequently, the steel plate of Test Number 3-15 did not exhibit excellent SSC resistance in the low-temperature SSC resistance test.

The steel plate of Test Number 3-16 was subjected to low-temperature tempering after being subjected to high-temperature tempering. As a result, Fn2 was 691 or less. Consequently, the steel plate of Test Number 3-16 did not exhibit excellent SSC resistance in the low-temperature SSC resistance test.

In the steel plate of Test Number 3-17, the Si content was too low. As a result, Fn2 was 691 or less. Consequently, the steel plate of Test Number 3-17 did not exhibit excellent SSC resistance in the low-temperature SSC resistance test.

In the steel plate of Test Number 3-18, the Cr content was too low. Consequently, the steel plate of Test Number 3-18 did not exhibit excellent SSC resistance in either the room-temperature SSC resistance test or the low-temperature SSC resistance test.

In the steel plate of Test Number 3-19, the Mo content was too low. As a result, Fn2 was 691 or less. Consequently, the steel plate of Test Number 3-19 did not exhibit excellent SSC resistance in either the room-temperature SSC resistance test or the low-temperature SSC resistance test.

In the steel plate of Test Number 3-20, the Mn content was too high. Consequently, the steel plate of Test Number 3-20 did not exhibit excellent SSC resistance in either the room-temperature SSC resistance test or the low-temperature SSC resistance test.

In the steel plate of Test Number 3-21, the N content was too high. Consequently, the steel plate of Test Number 3-21 did not exhibit excellent SSC resistance in either the room-temperature SSC resistance test or the low-temperature SSC resistance test.

In the steel plate of Test Number 3-22, the P content was too high. Consequently, the steel plate of Test Number 3-22 did not exhibit excellent SSC resistance in either the room-temperature SSC resistance test or the low-temperature SSC resistance test.

In the steel plate of Test Number 3-23, the Si content was too low. As a result, Fn2 was 691 or less. Consequently, the steel plate of Test Number 3-23 did not exhibit excellent SSC resistance in the low-temperature SSC resistance test.

In the steel plates of Test Numbers 3-24 and 3-25, Fn1 was 85 or less. As a result, Fn2 was 691 or less. Consequently, the steel plates of Test Numbers 3-24 and 3-25 did not exhibit excellent SSC resistance in either the room-temperature SSC resistance test or the low-temperature SSC resistance test.

In the steel plate of Test Number 3-26, the V content was too low. As a result, Fn2 was 691 or less. Consequently, the steel plate of Test Number 3-26 did not exhibit excellent SSC resistance in the low-temperature SSC resistance test.

In the steel plate of Test Number 3-27, the Mo content was too low. Consequently, the steel plate of Test Number 3-27 did not exhibit excellent SSC resistance in the low-temperature SSC resistance test.

In the steel plate of Test Number 3-28, the Mn content was too high. Consequently, the steel plate of Test Number 3-28 did not exhibit excellent SSC resistance in either the room-temperature SSC resistance test or the low-temperature SSC resistance test.

In the steel plate of Test Number 3-29, the Ti content was too high. Consequently, the steel plate of Test Number 3-29 did not exhibit excellent SSC resistance in either the room-temperature SSC resistance test or the low-temperature SSC resistance test.

In the steel plate of Test Number 3-30, the Nb content was too high. Consequently, the steel plate of Test Number 3-30 did not exhibit excellent SSC resistance in either the room-temperature SSC resistance test or the low-temperature SSC resistance test.

An embodiment of the present disclosure has been described above. However, the embodiment described above is merely an example for implementing the present disclosure. Accordingly, the present disclosure is not limited to the above embodiment, and the above embodiment can be appropriately modified and performed within a range that does not deviate from the gist of the present invention.

The invention claimed is:

1. A steel material consisting of, in mass %,
C: 0.20 to 0.45%,
Si: 1.36 to 3.20%,
Mn: 0.02 to 1.00%,
P: 0.025% or less,
S: 0.0100% or less,
Al: 0.005 to 0.100%,
Cr: 0.20 to 1.50%,
Mo: 0.36 to 1.50%,
V: 0.01 to 0.90%,
Ti: 0.002 to 0.050%,
B: 0.0001 to 0.0050%,
N: 0.0100% or less,
O: 0.0100% or less,
Nb: 0 to 0.030%,
Ca: 0 to 0.0100%,
Mg: 0 to 0.0100%,
Zr: 0 to 0.0100%,
rare earth metal: 0 to 0.0100%,
Co: 0 to 0.50%,
W: 0 to 0.50%,
Ni: 0 to 0.50%, and
Cu: 0 to 0.50%,
with the balance being Fe and impurities, and satisfying Formula (1),
wherein the steel material is a seamless oil-well steel pipe,
a yield strength $\sigma_{YS}$ is 758 MPa or more, and
the yield strength $\sigma_{YS}$ and a dislocation density ρ satisfy Formula (2):

$$27\times Mn+9\times Cr-14\times Mo-770\times C^2+760\times C-11\times Si^2+4\times Si>85 \quad (1)$$

$$691<\sigma_{YS}-110\times\sqrt{\rho}\times 10^{-7}\leq 795 \quad (2)$$

where, a content in mass % of a corresponding element is substituted for each symbol of an element in Formula (1); and in Formula (2) a yield strength in MPa is substituted for $\sigma_{YS}$, and a dislocation density in $m^{-2}$ is substituted for ρ.

2. The steel material according to claim 1, containing one or more elements selected from the group consisting of:
Nb: 0.002 to 0.030%,
Ca: 0.0001 to 0.0100%,
Mg: 0.0001 to 0.0100%,
Zr: 0.0001 to 0.0100%,
rare earth metal: 0.0001 to 0.0100%,
Co: 0.02 to 0.50%,
W: 0.02 to 0.50%,
Ni: 0.01 to 0.50%, and
Cu: 0.01 to 0.50%.

3. The steel material according to claim 1, wherein the seamless oil-well steel pipe has a wall thickness of 9 to 60 mm.

* * * * *